US007336692B2

(12) United States Patent
Lazor et al.

(10) Patent No.: US 7,336,692 B2
(45) Date of Patent: Feb. 26, 2008

(54) INDUCTION FURNACE FOR MELTING SEMI-CONDUCTOR MATERIALS

(76) Inventors: David A. Lazor, 5581 Kingwood La., Girard, OH (US) 44420; Daniel J. Pupillo, 10062 Hoover Ave., NW., Uniontown, OH (US) 44685; Jeffrey P. Deeter, 1477 Waters Edge Dr., Akron, OH (US) 44313; Thomas J. Todaro, 130 Gunn Rd., Branchville, NJ (US) 07826; Anthony M. Tenzek, 30218 Speidel Rd., Hanoverton, OH (US) 44423

( * ) Notice: Subject to any disclaimer, the term of this patent is extended or adjusted under 35 U.S.C. 154(b) by 0 days.

(21) Appl. No.: 11/193,790

(22) Filed: Jul. 29, 2005

(65) Prior Publication Data

US 2006/0050763 A1 Mar. 9, 2006

Related U.S. Application Data

(63) Continuation-in-part of application No. 10/851,567, filed on May 21, 2004.

(51) Int. Cl.
*H05B 6/44* (2006.01)
*H05B 6/22* (2006.01)

(52) U.S. Cl. ..... 373/156; 373/144; 373/149

(58) Field of Classification Search ..... 373/156, 373/18, 5, 6, 7, 59, 138–142, 144, 146, 149, 373/151, 152, 157, 159; 219/634, 651; 65/17.6, 65/144, 335, 29.16; 75/564; 266/45; 117/18; 588/314

See application file for complete search history.

(56) References Cited

U.S. PATENT DOCUMENTS

| | | | | |
|---|---|---|---|---|
| 1,655,983 | A * | 1/1928 | Brace | 373/159 |
| 3,582,287 | A * | 6/1971 | Capita | 117/214 |
| 4,312,658 | A * | 1/1982 | Mayer | 65/29.16 |
| 4,802,919 | A * | 2/1989 | Fey | 75/504 |
| 5,177,304 | A * | 1/1993 | Nagel | 588/314 |
| 5,939,016 | A * | 8/1999 | Mathiesen et al. | 266/45 |
| 6,027,563 | A * | 2/2000 | Choudhury et al. | 117/18 |
| 6,125,658 | A * | 10/2000 | Maugendre et al. | 65/135.6 |
| 6,361,597 | B1 | 3/2002 | Takase et al. | |

* cited by examiner

*Primary Examiner*—Quang Van
(74) *Attorney, Agent, or Firm*—Sand + Sebolt

(57) ABSTRACT

An induction furnace includes an induction coil, an electrically non-conductive crucible having an inner diameter disposed within the induction coil, and an electrically conductive member disposed below the crucible and having an outer diameter which is further from the induction coil than is the inner diameter of the crucible. Due to the non-conductive nature of material disposed within the crucible at lower temperatures, the induction coil initially inductively heats the conductive member, which transfers heat to the material to melt a portion of the material. Once the material is susceptible to inductive heating (usually upon melting) the susceptible material is inductively heated by the induction coil. During the process, inductive heating of the material greatly increases as inductive heating of the conductive member greatly decreases due to low resistivity of the molten material and due to the molten material being closer to the coil than is the conductive member.

54 Claims, 21 Drawing Sheets

INDUCTION FURNACE FOR MELTING SEMI-CONDUCTOR MATERIALS

CROSS REFERENCE TO RELATED APPLICATIONS

This application is a continuation-in-part of U.S. patent application Ser. No. 10/851,567 filed May 21, 2004; the disclosure of which is incorporated herein by reference.

BACKGROUND OF THE INVENTION

1. Technical Field

The invention relates to induction heating and an improved induction furnace. More particularly, the invention relates to an induction furnace for melting materials not susceptible to inductive heating at lower temperatures but which are susceptible to inductive heating at higher temperatures, especially upon melting. Specifically, the invention relates to an induction furnace having an electrically conductive susceptor disk which is inductively heated whereby heat is transferred from the disk to such materials to make them susceptible to inductive heating whereby the materials are then inductively heated to melt them.

2. Background Information

Induction furnaces are well known in the art. However, there are a variety of difficulties related to the inductive heating and melting of materials that are initially non-conductive or which have particle sizes sufficiently small so that they are not susceptible to inductive heating. Many prior art induction furnaces utilize a conductive crucible such that an induction coil couples with the crucible to transfer energy directly to the crucible to heat the crucible. Heat is then transferred from the crucible to the material to be melted via thermal conduction. In certain cases, the induction frequency and the thickness of the crucible wall may be selected so that a portion of the electromagnetic field from the coil allows coupling with any electrically conductive material inside the crucible to inductively heat the material directly. However, the direct inductive heating in such cases is quite limited. Because direct inductive heating of the material to be melted is far more effective than the method described above, a system to effect such direct inductive heating is highly desirable.

In addition, the conductive crucibles of the prior art may react with the material to be melted which causes unwanted impurities in the melt and thus requires the use of a non-reactive liner inside the crucible to prevent formation of such impurities. Typically, such liners are electrically non-conductive and thermally insulating. As a result, the transfer of heat from the crucible to the materials to be melted is greatly impeded, thus substantially increasing melting times. To expedite the transfer of heat from the crucible to the material to be melted, the crucible must be heated to undesirably high temperatures which can decrease the life of the crucible and liner.

In addition, there remains a need for an induction furnace capable of producing a continuous melt in an efficient manner, especially for semi-conductor materials. An efficient continuous melt induction furnace is particularly useful for continuous formation of semi-conductor crystals, which are highly valued in the production of computer chips.

U.S. Pat. No. 6,361,597 to Takase et al. teaches three embodiments of an induction furnace especially intended for melting semi-conductor materials and adapted to supply the molten material to a main crucible for pulling of semi-conductor crystals therefrom. Unlike the prior art discussed above, Takase et al. uses a quartz crucible which is electrically non-conductive along with a susceptor which is in the form of a carbon or graphite cylinder. In each of the three embodiments of Takase et al., the carbon or graphite cylinder susceptor is initially inductively heated by a high frequency coil whereby heat is transferred from the susceptor to raw material inside the crucible in order to begin the melting process. Once the raw material is melted, it is directly inductively heated by the high frequency coil in order to speed up the melting process. While this is a substantial improvement over the previously discussed prior art, the induction furnace of Takase et al. still leaves room for improvement, as discussed below.

The first embodiment of Takase et al. involves the use of a pipe extending upwardly into the quartz crucible whereby the pipe receives molten material from within the crucible by overflow and transmits it to a main crucible from which semi-conductor crystals are pulled. The carbon cylinder susceptor encircles the quartz crucible and is moveable in a vertical direction. Prior to melting the material in the crucible, the carbon cylinder is positioned so it covers the entire side wall of the crucible. Once some of the material is melted, the carbon cylinder is moved upwardly so that the molten material is inductively heated by the coil. Once the raw material is fully melted, additional raw material is added and the carbon cylinder is moved downwardly to cover the upper half of the side wall of the crucible so that the carbon cylinder is inductively heated and transfers heat therefrom to aid in melting the added raw material.

While the first embodiment of Takase et al. permits the susceptor to be substantially removed from the electromagnetic field of the induction coil so that it is not further inductively heated or so that the inductive heat is minimized therein, this process still has some disadvantages. One disadvantage to this configuration is the need to provide a mechanism to move the cylindrical susceptor upwardly and downwardly. Another disadvantage of the configuration is the need for a mechanism to monitor the melt in order to determine the proper time to move the susceptor away from the crucible side wall. Because direct inductive heating of the molten materials is more effective than inductive heating of the susceptor and subsequent transfer of heat from the susceptor to the material, any time that the susceptor is left in place after the molten material is susceptible to inductive heating, it prevents the more efficient direct inductive heating of the melt.

The second embodiment in Takase is similar to the first embodiment except that the pipe for transferring molten material from the quartz crucible to the main crucible does not extend upwardly into the quartz crucible. A mass of the initial raw material is disposed over the opening of the pipe and effectively serves as a stopper until the stopper portion is itself melted. In order to prevent the stopper from being melted too soon, the carbon cylinder initially only covers about two thirds of the upper portion of the side wall of the crucible so that heat transferred from the carbon cylinder is transmitted only to about the upper two thirds of the raw material. As the raw material is melted, the carbon cylinder is moved downward to cover the entire side wall of the crucible. Then the carbon cylinder is moved upwardly to cover the upper half of the side wall of the crucible whereby continued inductive heating of the carbon cylinder allows heat transfer from the carbon cylinder to raw material that is added to the melt. Induction heat is also generated in the melt at this point.

The second embodiment similarly suffers from the need for moving the cylindrical susceptor in a vertical fashion.

The process must also be monitored in order to determine when to move the susceptor cylinder downwardly to maintain a reasonably high efficiency. Further, the susceptor interferes with the inductive heating of the molten material when positioned around the crucible while there is still unmelted raw material within the crucible.

In the third embodiment, Takase et al. provides a pipe which extends upwardly into the crucible as in the first embodiment to provide overflow of the molten material to the main crucible. In this embodiment, the susceptor has a crucible-like configuration whereby the susceptor cylindrical portion covers the sidewall of the quartz crucible and the bottom of the susceptor covers the lower surface of the quartz crucible. In this embodiment, the susceptor is not vertically moveable. Instead, the thickness of the susceptor sidewall and the frequency applied by the coil are selected so that the penetration depth of the induction current will extend beyond the susceptor into the quartz crucible so that it can inductively heat material inside. As with the prior embodiments, the susceptor is inductively heated and then transfers heat to the raw material to begin the melting process. Once the melting process has begun, inductive heating of the melt also occurs and the melt continues as a result of both inductive heating directly of the molten material as well as transferred heat from the inductively heated susceptor. In addition, the frequency applied to the coil is preferably initially at a relatively high frequency and then once the melting has begun is shifted to a relatively low frequency to better focus inductive heating of the molten portion of the material.

This third embodiment primarily suffers from the fact that the cylindrical susceptor remains in place and thus prevents inductive heating from being focused more effectively on the raw material within the crucible. Instead, the coil continues to inductively heat the carbon cylinder so that energy which might be applied to the material is absorbed by the carbon cylinder, which transfers heat to the raw material in the crucible in a far less effective manner.

BRIEF SUMMARY OF THE INVENTION

The present invention provides an induction furnace comprising an electrically non-conductive crucible defining a melting cavity; an electrically conductive member disposed adjacent the crucible; an induction member for inductively heating material within the melting cavity; and a portion of the melting cavity being closer to the induction member than is the conductive member.

The present invention also provides an induction furnace for melting material, the furnace comprising an electrically non-conductive crucible defining a melting cavity; an electrically conductive member disposed adjacent the crucible in a fixed relation with respect to the crucible; an induction member for creating an electromagnetic field to inductively heat material within the melting cavity and to inductively heat the conductive member; each of the conductive member and the material within the melting cavity absorbing energy from the electromagnetic field whereby the conductive member and material together absorb a combined energy from the electromagnetic field; the crucible, conductive member and induction member being positioned with respect to each other so that inductive heating via the induction member occurs initially within the conductive member and occurs in the material within the melting cavity when the conductive member has transferred sufficient heat to the material to make the material susceptible to inductive heating so that at a certain time during inductive heating the conductive member absorbs no more than thirty percent of the combined energy absorbed by the conductive member and material.

The present invention further provides an induction furnace for melting material, the furnace comprising an induction member for creating an electromagnetic field; an electrically non-conductive crucible defining a melting cavity containing the material to be melted; the material absorbing over time a varying amount of energy created by the magnetic field; an electrically conductive member disposed adjacent the crucible in a fixed relation with respect to the crucible; the conductive member absorbing over time a varying amount of energy created by the magnetic field; and the crucible, conductive member and induction member being positioned with respect to each other so that during heating and melting of the material the amount of energy from the electromagnetic field absorbed by the conductive member to create inductive heating therein is substantially inversely proportional to the amount of energy from the electromagnetic field absorbed by the material in the melting cavity to create inductive heating therein.

The present invention also provides a method of heating comprising the steps of placing material within a melting cavity of an electrically non-conductive crucible; positioning an electrically conductive member and an induction member so that a portion of the melting cavity is closer to the induction member than is the conductive member; heating the conductive member inductively with the induction member; transferring heat from the conductive member to the material; and heating a portion of the material inductively with the induction member.

The present invention also provides a method of heating a material comprising the steps of placing a material within a melting cavity of an electrically non-conductive crucible; positioning a conductive member and an induction member so that a portion of the melting cavity is closer to the induction member than is the conductive member; heating the conductive member resistively; transferring heat from the conductive member to the material; and heating a portion of the material inductively with the induction member.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
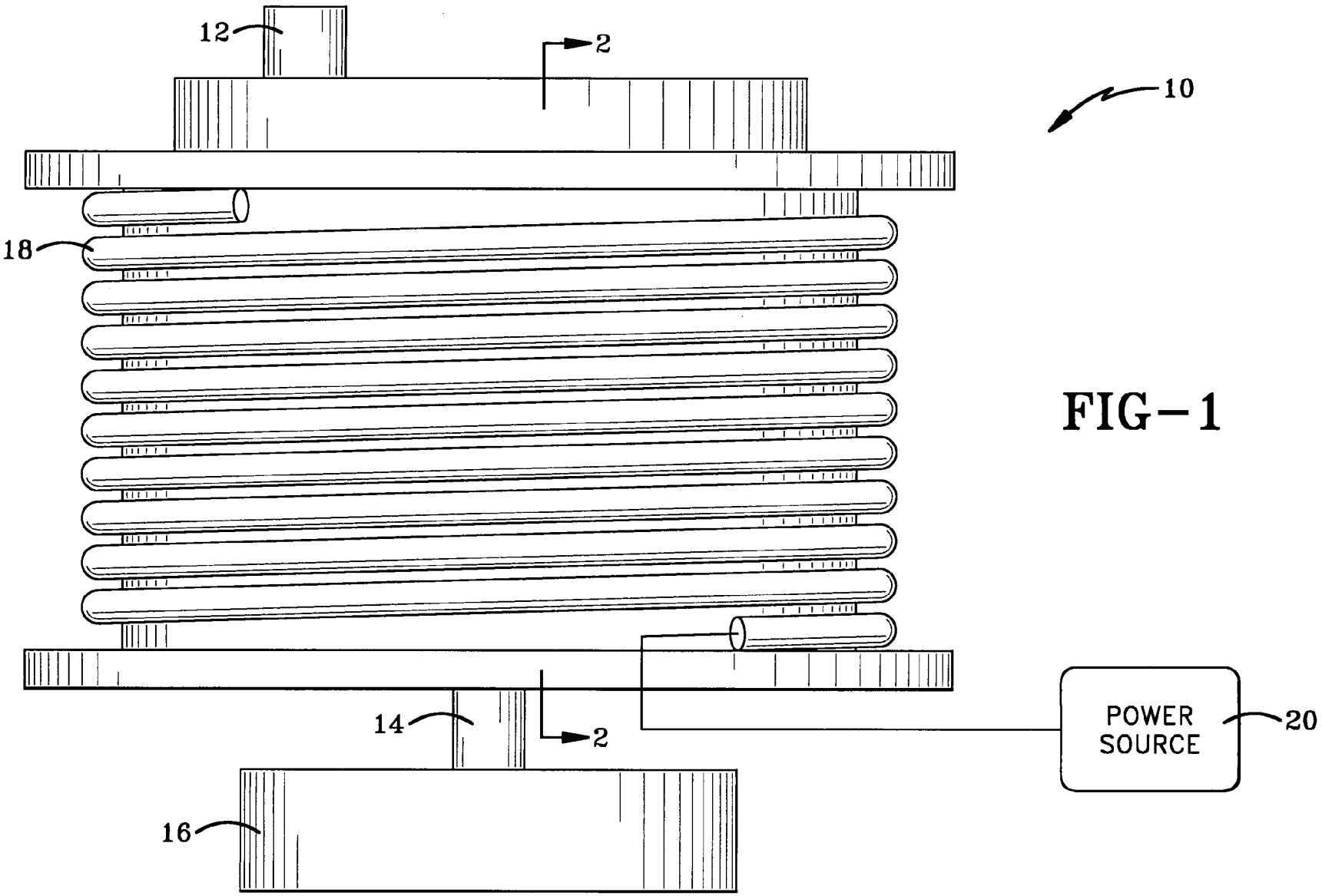
FIG. 1 is a side elevational view of a first embodiment of the induction furnace of the present invention in an environment adapted for continuous melting and crystal formation.
Figure 2:
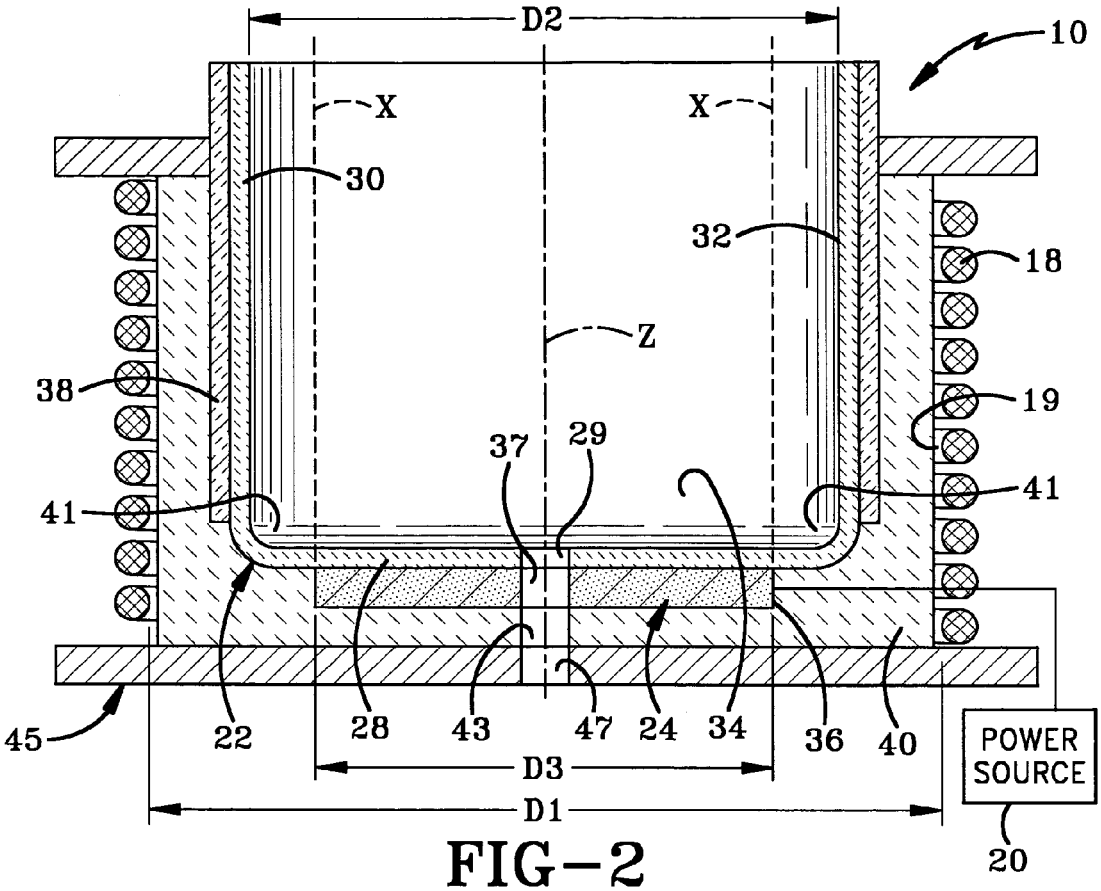
FIG. 2 is a sectional view taken on line 2-2 of FIG. 1 wherein the crucible is empty.
Figure 17:
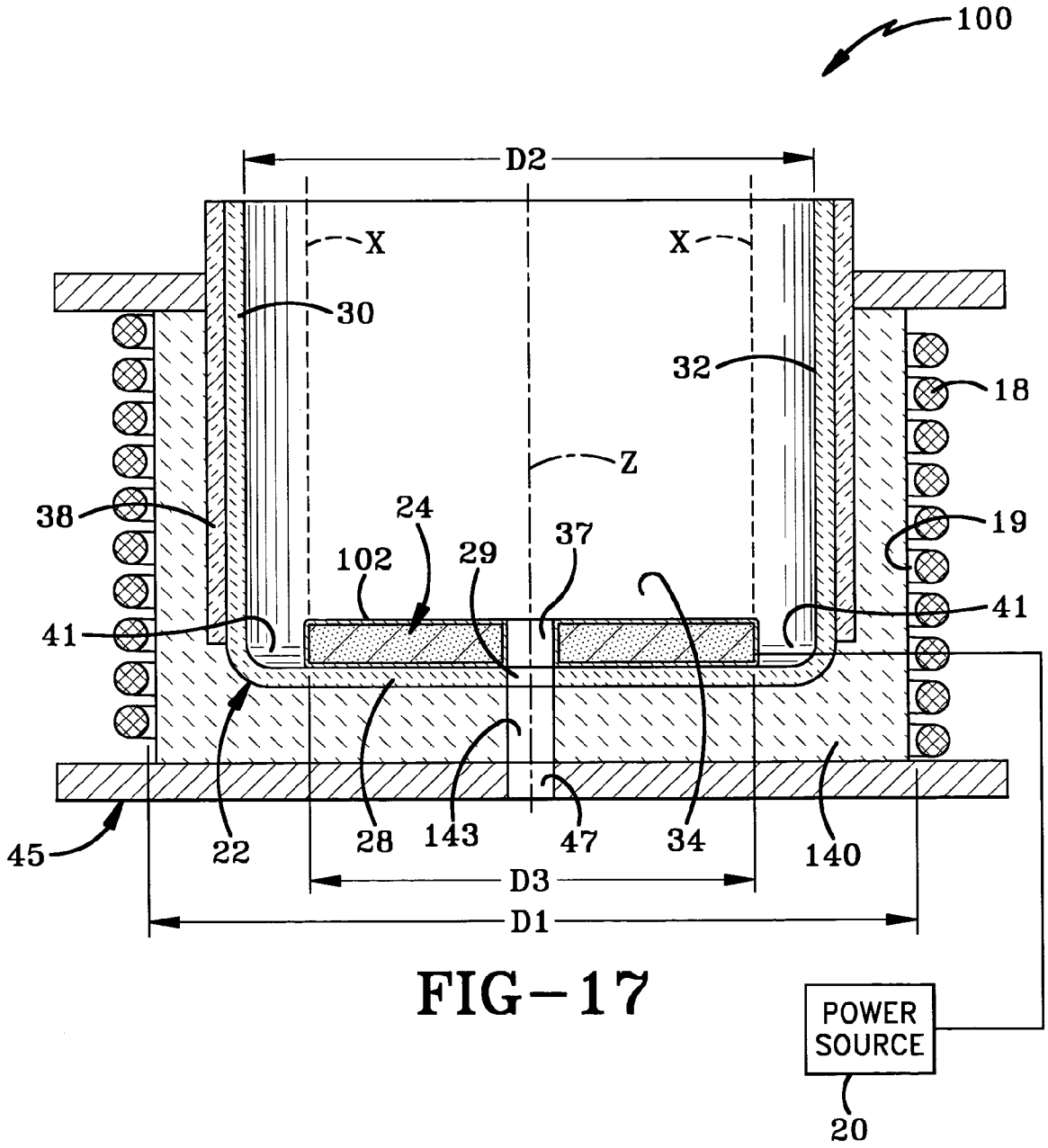
FIG. 17 is sectional view similar to FIG. 2 of a second embodiment of the induction furnace of the present invention showing the susceptor within the melting cavity of the crucible.

A first embodiment of the induction furnace of the present invention is indicated generally at 10 in FIGS. 1-2, and a second embodiment is indicated generally at 100 in FIG. 17. Furnaces 10 and 100 are configured to melt material which is electrically non-conductive at relatively lower temperatures and electrically conductive at relatively higher temperatures or upon melting, such as semi-conductor materials, or to melt material having particle sizes sufficiently small so that they are not susceptible to inductive heating even if of an electrically conductive material. The invention is particularly useful for melting semi-conductor materials and while reference may be made to semi-conductor materials in the application, this should not be deemed to limit the scope of the invention. Furnaces 10 and 100 may also be used with fibrous materials or other materials having geometries which are particularly difficult to melt via inductive heating. Heating liquids is also an option, as detailed further below. While the invention is thus widely applicable, the exemplary embodiment describes the heating and melting of solid material in particulate form.

Furnace 10 is shown in FIG. 1 in an environment for continuous or intermittent melting and production of semi-conductor crystals wherein furnace 10 is adapted to utilize a feed mechanism 12, a transfer or pouring mechanism 14 and a receiving crucible or tundish 16 for receiving molten material from furnace 10 via pouring mechanism 14.

Figure 3:
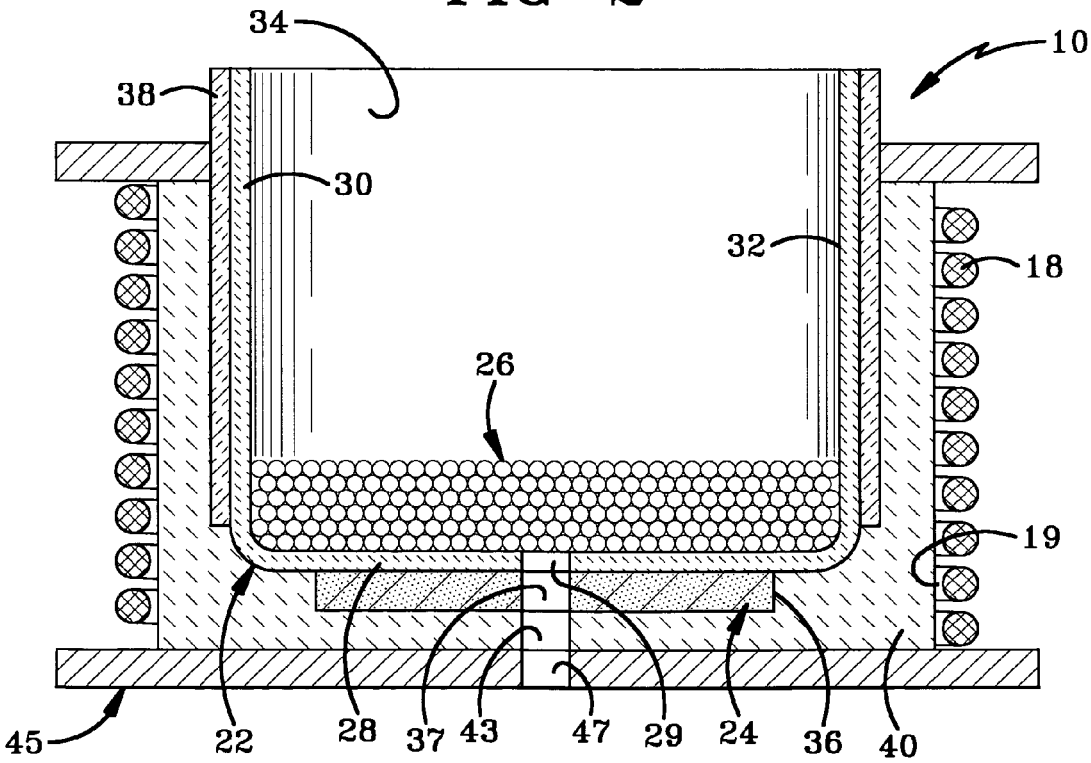
FIG. 3 is a sectional view similar to FIG. 2 except the crucible contains solid material to be melted.

With reference to FIGS. 1-3, furnace 10 includes an induction member or induction coil 18 connected to a power source 20. Coil 18 is substantially cylindrical although it may taken a variety of shapes. Coil 18 defines an interior space 19 and has an interior diameter D1 as shown in FIG. 2. Furnace 10 also includes a crucible 22 and an electrically conductive member referred to in the induction heating industry as a susceptor 24. Furnace 10 is configured so that electrical current passing through coil 18 creates an electromagnetic field which couples initially with susceptor 24 to inductively heat susceptor 24 and thereby transfers heat by conduction and radiation from susceptor 24 to unmelted raw material 26 (FIG. 3) in order to melt a portion of raw material 26. Furnace 10 is further configured so that the portion of material 26 which is molten is inductively heated by coil 18 so that the inductive heating of molten material 26 far exceeds the inductive heating of susceptor 24.

Crucible 22 includes a bottom wall 28 and a cylindrical sidewall 30 extending upwardly therefrom. Bottom wall defines an exit opening 29. Sidewall 30 has an inner surface 32 defining an inner diameter D2, as shown in FIG. 2. Bottom wall 28 and sidewall 30 define a melting cavity 34 there within. Crucible 22 is formed of an electrically non-conductive material. While a variety of materials may be suitable for different applications, quartz is usually preferred for use with melting of semi-conductor materials, especially silicon.

Susceptor 24 may take a variety of shapes, but preferably is in the form of a cylindrical disk having an outer perimeter 36 and defining a hole 37. Outer perimeter 36 defines an outer diameter D3 (FIG. 2) which is smaller than diameter D2 of crucible 22. Susceptor 24 is formed of an electrically conductive material suitable for inductive heating, such as graphite. Susceptor 24 is disposed below crucible 22 closely adjacent bottom wall 28 and preferably in abutment therewith. An insulator 38 encircles sidewall 30 of crucible 22 and a refractory material 40 surrounds a substantial portion of crucible 22 and is seated on a support 45. Material 40 defines a hole 43 and support 45 defines a hole 47. Exit opening 29 of crucible 22 and holes 37, 43, and 45 are aligned to allow molten material to flow via pouring mechanism 14 into tundish 16.

Alternately, susceptor 24 may be replace with one or more heating elements connected to power source 20 (FIG. 2). Thus, the heating elements may be resistively heated via an electrical current from power source 20. In addition, these resistive heating elements may be inductively heated by induction coil 18. As a result, the conductive member may be heated by induction, by resistance or both, depending on the material used and the configuration thereof.

In accordance with one of the main features of the invention, outer perimeter 36 of susceptor 24 is further away from coil 18 than is inner surface 32 of crucible 22 sidewall 30 as shown by the difference of diameters D1, D2 and D3 in FIG. 2. More particularly, some of the space within melting cavity 34 is closer to coil 18 than is susceptor 24 so that a portion of molten material may be disposed within said space, indicated at 41 in FIG. 2, and thus be closer to coil 18 than is susceptor 24. Space 41 is disposed between inner surface 32 of sidewall 30 and an imaginary cylinder defined by lines X (FIG. 2) extending upwardly from outer perimeter 36 of susceptor 24. Preferably, coil 18, inner surface of sidewall 30 and outer perimeter 36 of susceptor 24 are all concentric about an axis Z (FIG. 2).

In operation, and with reference to FIGS. 2-8, furnace 10 functions as follows. FIG. 2 shows furnace 10 prior to being charged with raw material 26. FIG. 3 shows an initial charge of raw material 26 having been placed into melting cavity 34 of crucible 22. While a greater amount of material 26 may be placed initially in crucible 22, additional material 26 hinders the initial melting process by dispersing heat over a greater amount of material. Once material 26 has been added to crucible 22, electrical power is provided from power source 20 to coil 18 to create an electromagnetic field around coil 18 which flows in the direction of Arrows A in FIGS. 4-8. Prior to the melting of any of material 26, the electromagnetic field from induction coil 18 produces induction heating within susceptor 24. In the initial phase, material 26 is not susceptible to inductive heating. As previously noted, this may be because material 26 is not electrically conductive at a relatively low temperature, or it may be because material 26 is of sufficiently small particles to prevent the flow of electrical current as a result of the small contact area between particles, or both. Once susceptor 24 is inductively heated, susceptor 24 transfers heat by conduction and/or radiation through crucible 22 in order to melt a portion of material 26, a molten portion 42 being shown in FIGS. 4-7.

Alternately, where conductive member (24) is one or more resistive heating elements, power source 20 provides electrical power to resistively heat the heating elements, which in turn transfer heat conductively and radiantly in the same manner as described above with regard to susceptor 24 after being inductively heated. If desired, the heating elements may also be simultaneously inductively heated by induction coil 18. Whether heated only resistively or in combination with inductive heating, a portion of material 26 is thus heated and melted. Where only resistive heating is used to melt the initial portion of material 26 so that it becomes inductively heatable, power to the heating elements for heating by resistance is then halted and induction coil 18 is powered to inductively heat the susceptible portion of material 26, as described below. The operation with respect to the use of susceptor 24 below is essentially the same for the use of resistive heating elements, although there may be some variations within the scope of the inventive concept. For instance, the configuration of the heating elements may lend themselves to inductive heating to a greater or lesser degree, and thus a certain configuration may act very similarly to susceptor 24 with regard to the inductive heating of the heating elements whereas another configuration may not be nearly as susceptible to inductive heating. To the extent that the heating elements are inductively heatable, the concepts discussed below regarding the inductive heating aspects of susceptor 24 also hold true for such heating elements.

Figure 4:
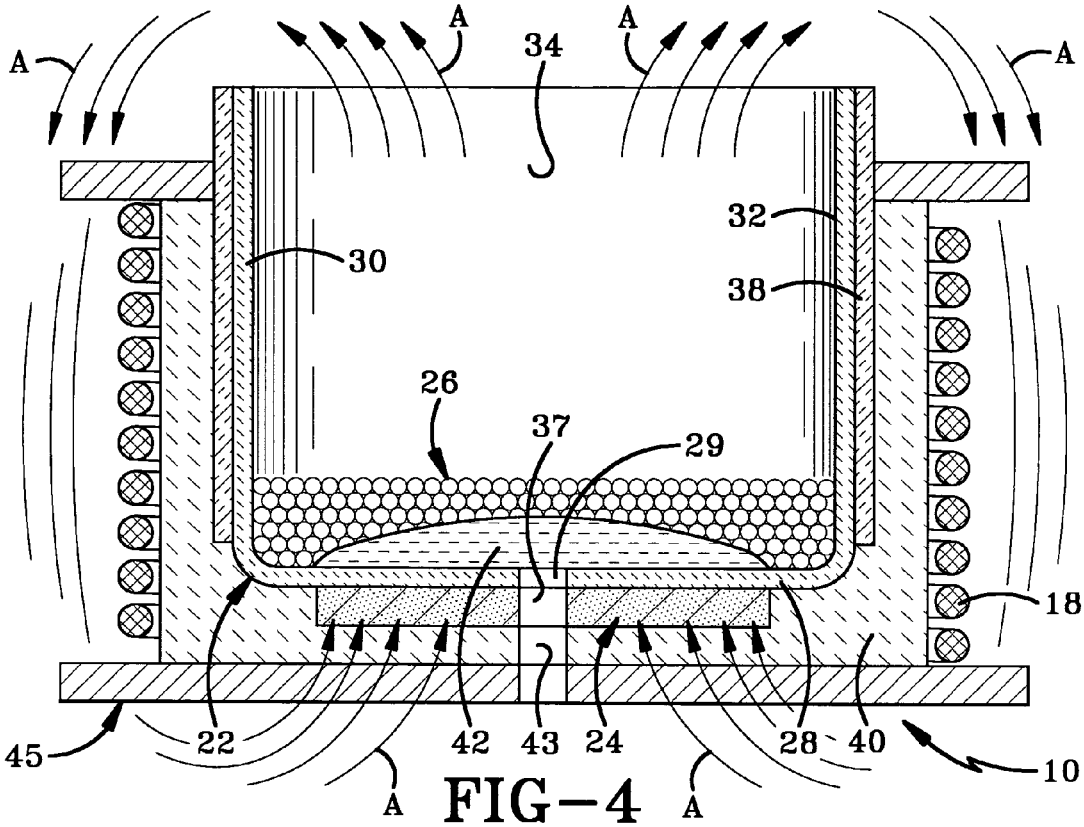
FIG. 4 is similar to FIG. 3 and shows a stage wherein a portion of the material is melted with arrows representing an electromagnetic field.
Figure 5:
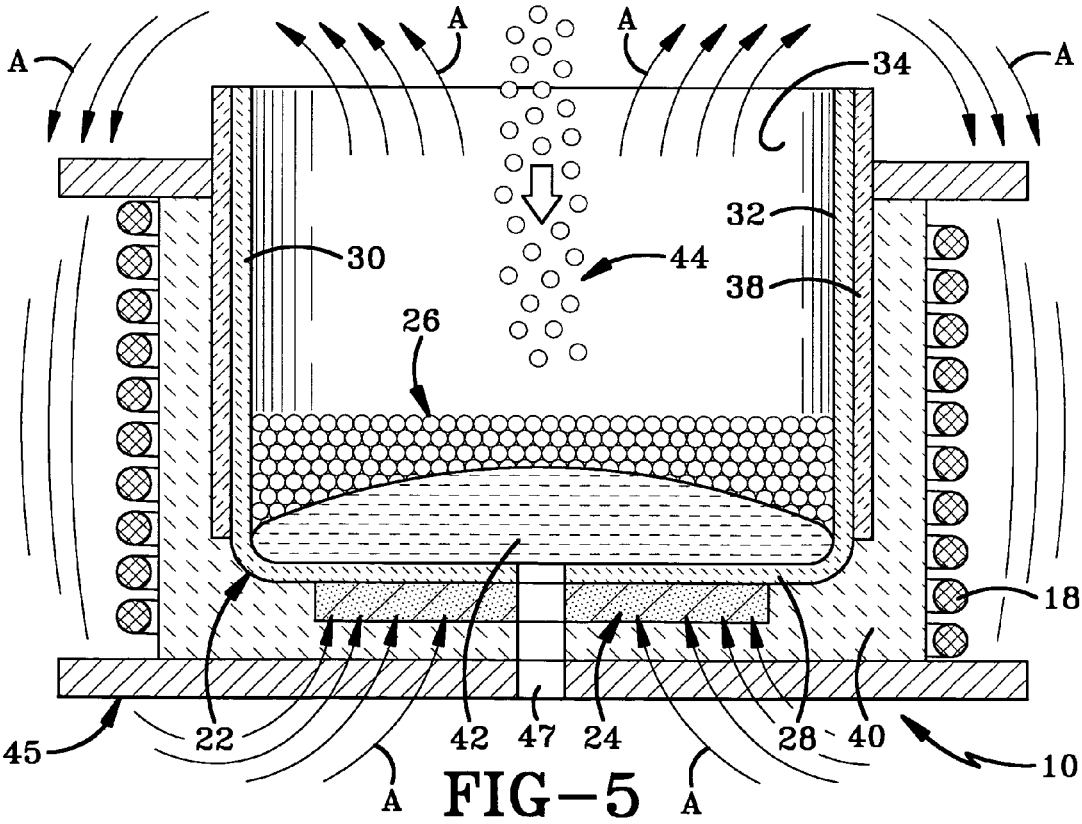
FIG. 5 is similar to FIG. 4 and shows a further stage of melting and additional material being added to the crucible.

Molten portion 42 is electrically conductive and is susceptible to inductive heating by coil 18. Thus, coil 18 begins to inductively heat molten portion 42 while simultaneously inductively heating susceptor 24. In general, as the molten portion within crucible 22 grows, inductive heating of the molten portion increases and inductive heating of susceptor 24 decreases. FIG. 4 shows molten portion 42 having an outer perimeter which extends laterally outwardly to approximately the same distance as outer perimeter 36 of susceptor 24. At this point, inductive heating of molten portion 42 is occurring, but is not as pronounced as in FIG. 5 where the molten portion has extended outwardly to inner surface 32 of crucible side wall 30. At the stage shown in FIG. 5, inductive heating of molten portion is substantially increased due to the molten portion extending closer to coil 18 than does outer perimeter 36 of susceptor 24. As a result, inductive heating of susceptor 24 is decreasing as the inductive heating of the molten material is increasing. FIG. 5 also shows additional material 44 being added to melting cavity 34. The addition of such material may occur while there is still unmelted material in the crucible or once all the material is molten.

Figure 6:
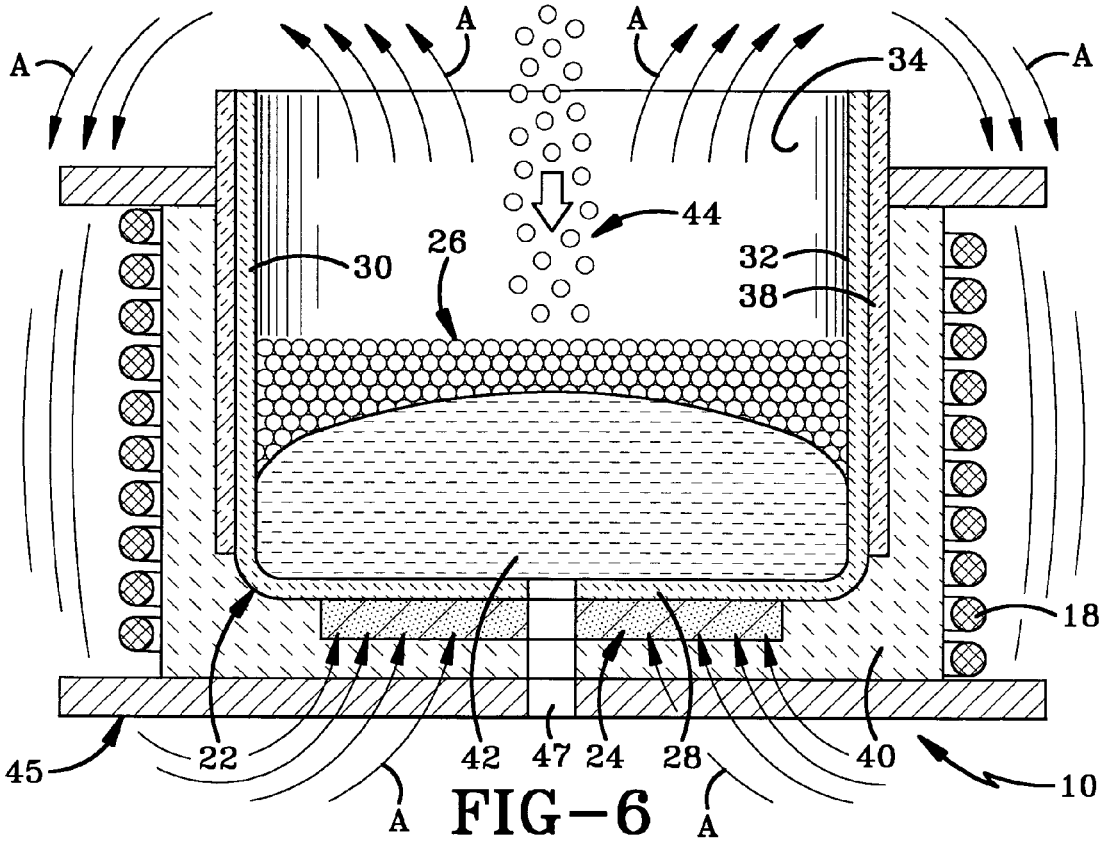
FIG. 6 is similar to FIG. 5 and shows a further stage of melting and additional material being added to the crucible.
Figure 7:
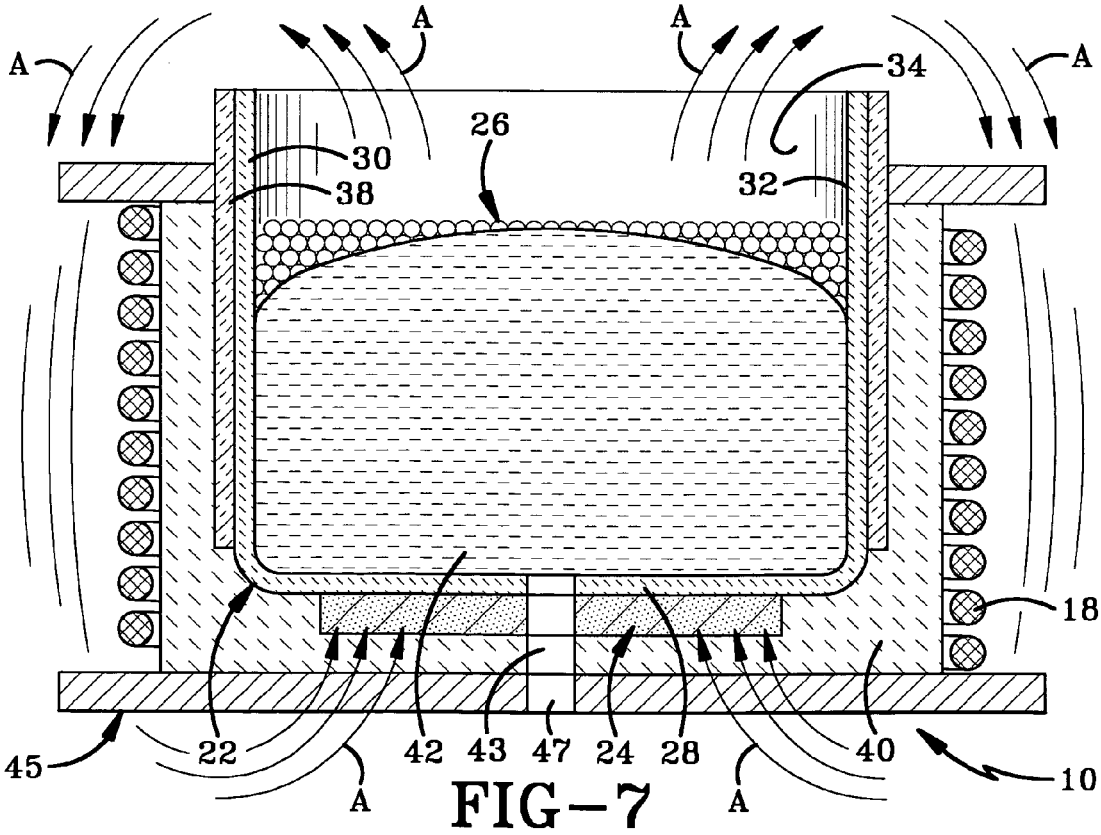
FIG. 7 is similar to FIG. 6 and shows a still further stage wherein nearly all the material is molten.
Figure 8:
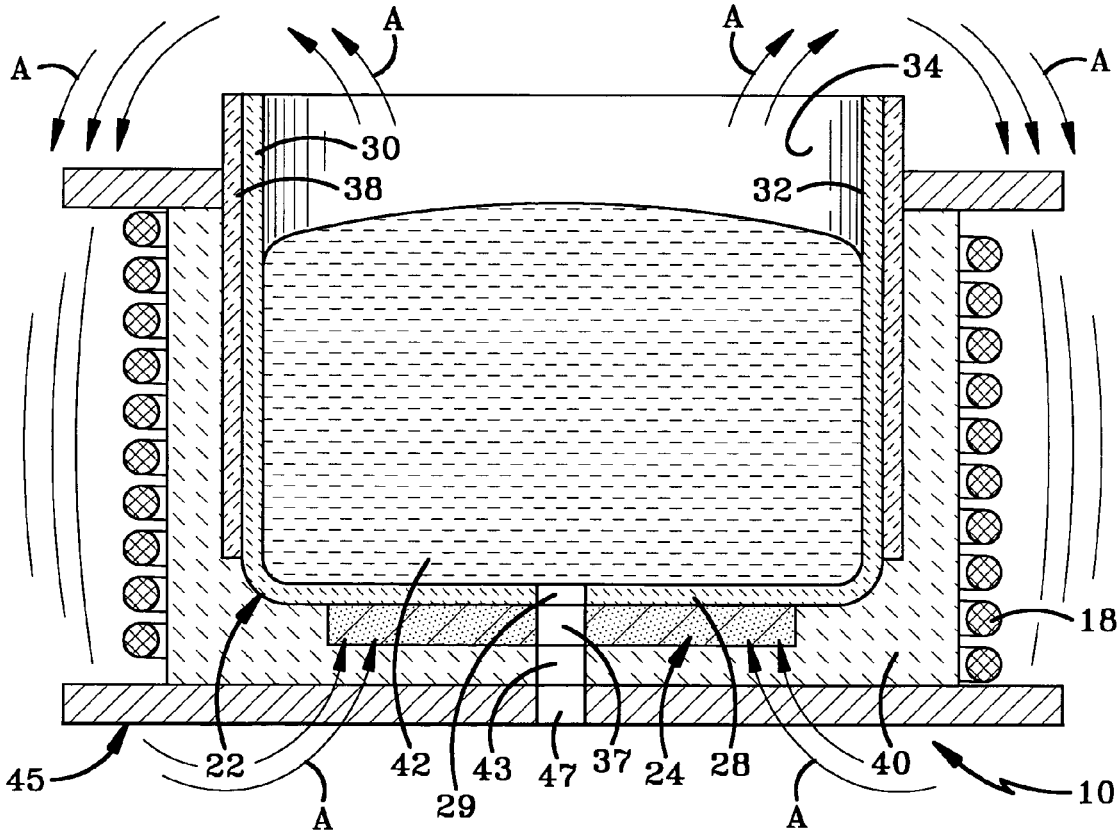
FIG. 8 is similar to FIG. 7 and shows all the material in the crucible is molten.

FIG. 6 shows a further stage of melting wherein the inductive heating continues to increase within the molten material and decrease within susceptor 24. Additional material 44 is also being added in FIG. 6. FIG. 7 shows raw material 26 almost fully melted and at a stage where the inductive heating of susceptor 24 is minimal and most of the inductive heating is occurring within the molten material. FIG. 8 shows all the raw material 26 having been melted and at a stage where the inductive heating of susceptor 24 is quite minimal.

Figure 9:
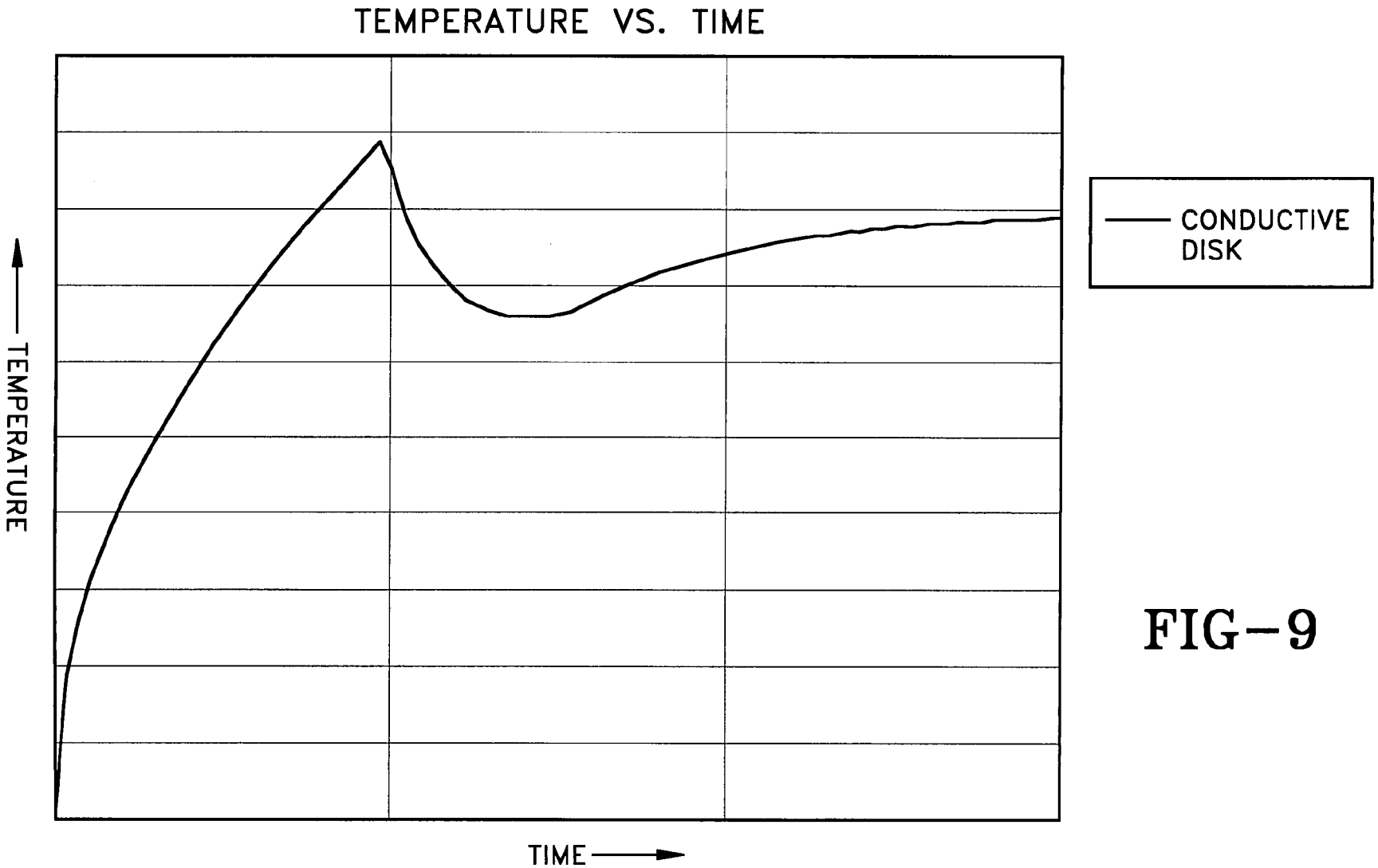
FIG. 9 is a graph showing the temperature of the conductive disk during the melting process.

In the earlier stages of the heating/melting process, heat was being transferred by conduction and radiation from susceptor 24 into raw materials 26 via crucible 22. However, a reversal occurs wherein the inductive heating of susceptor 24 is sufficiently reduced and the inductive heating of molten material 42 sufficiently increased so that heat from molten material 42 in crucible 22 is being transferred through crucible 22 into susceptor 24. This is illustrated in part in FIG. 9, which shows the temperature of susceptor 24 over time. Susceptor 24 is referred to in FIGS. 9-10 as "conductive disk". The graph of FIG. 9 illustrates that the temperature of the conductive disk increases relatively steeply until it reaches a peak and then drops off fairly substantially and then gradually increases. The sharp increase in the temperature of the disk is related to the inductive heating thereof which peaks about the point when materials within the crucible begin to melt and become inductively heatable by the coil. As direct inductive heating of the raw material increases and inductive heating of the susceptor or conductive disk drops off rather sharply, the temperature likewise drops a fairly substantial amount. Then, once the molten material increases in heat and volume, the heat within the molten material is transferred by conduction and radiation back through crucible 22 to the conductive disk, thereby heating it back up gradually to a certain level. This latter increase in heat is due almost entirely to the transfer of heat from the molten material, as inductive heating of the conductive disk becomes fairly minimal once the material is fully molten or fairly shortly before the fully molten stage.

Figure 10:
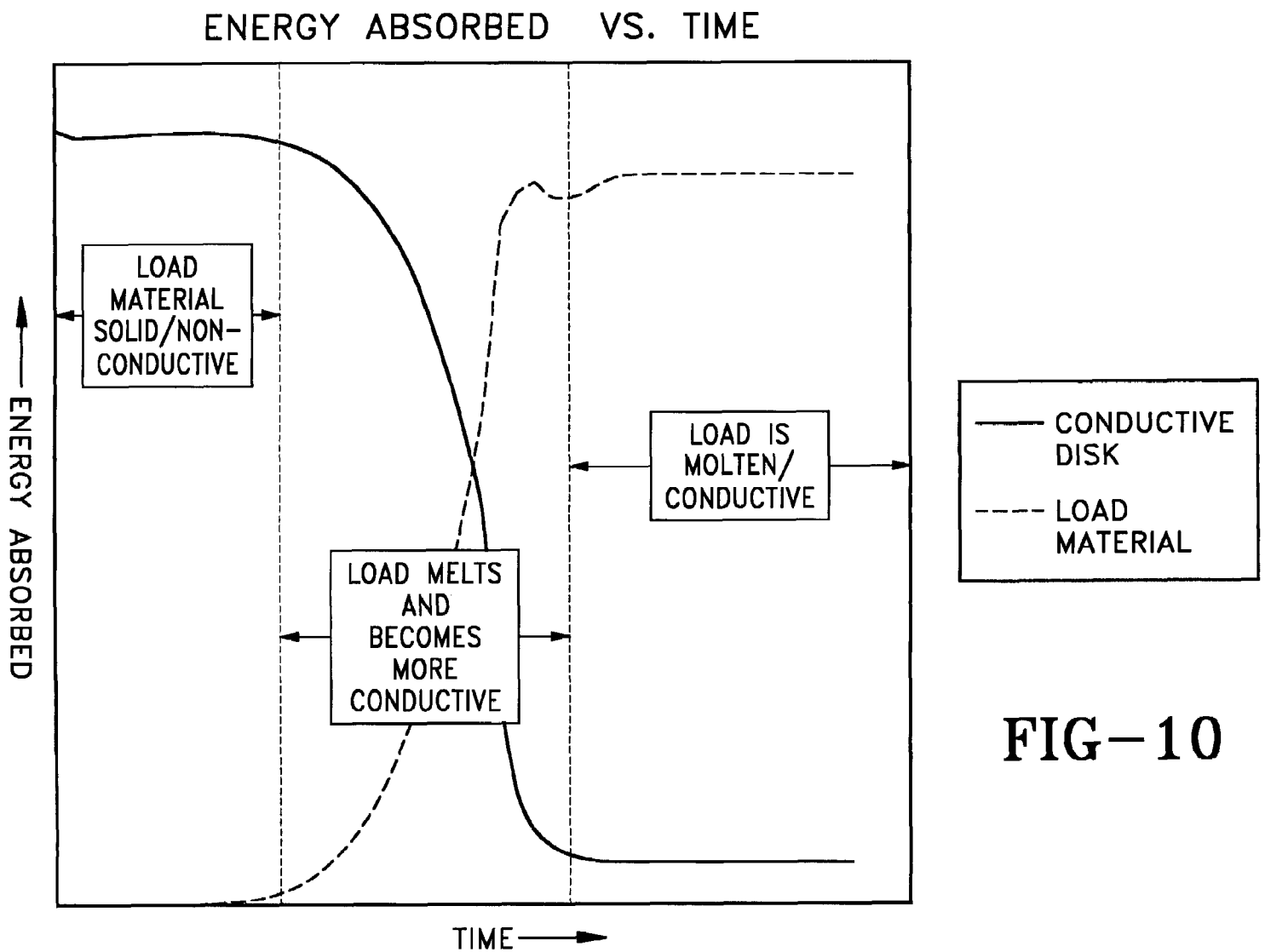
FIG. 10 is a graph showing energy consumed over time by the conductive disk and the material to be melted.

FIG. 10 shows the energy absorbed from the electromagnetic field of induction coil 18 by both the conductive disk and the load material or raw material to be melted during the melting process. As clearly illustrated, the conductive disk absorbs essentially all of the energy that is going toward inductive heating in the initial stage of the inductive heating process and then decreases sharply as the load melts and becomes more conductive so that it is consequently inductively heatable. Once the materials are fully molten and even prior to that, the energy being absorbed by the conductive disk through inductive heating is minimal in comparison to the energy being absorbed by the material. By contrast, the load material receives essentially no energy through inductive heating at the beginning of the process when the material is at lower temperatures.

With continued reference to FIG. 10, once the raw material becomes sufficiently hot to conduct electricity, which may be at the time of melting or at some point prior, the energy absorbed by the load material increases fairly sharply and in substantially inverse relation to the energy going to the conductive disk as the material melts and becomes more conductive. Once the material is almost fully melted, and after it is fully melted, nearly all of the energy going to inductive heating is being absorbed by the molten load material. In effect then, the conductive disk has nearly "disappeared" to the electromagnetic field of coil 18 in the sense that virtually all of the energy being absorbed by the load material and the conductive disk in combination, is being absorbed by the load material as opposed to the conductive disk once the material is fully molten or nearly fully molten. This process happens automatically due to the nature of inductive heating whereby the magnetic field tends to be attracted to electrically conductive materials that are closer to the coil.

With further reference to FIG. 10, of the combined energy being absorbed by the susceptor and by the material susceptible to inductive heating (hereinafter "the combined energy"), the percentage of energy being absorbed by the susceptor reaches values lower than possible with known induction furnaces. While the percentage of the combined energy being absorbed by the susceptor is initially 100 percent or very close thereto, that percentage drops drastically during the melting process. The percentage of the combined energy absorbed by the susceptor at a given time during the melting process may be as low as 1 (one) percent or even less. However, under certain circumstances, depending on the particular material to be melted and in order to create overall optimal conditions of power consumption, it may not be possible to obtain such a low percentage. Nonetheless, for many practical applications, percentages for the energy absorbed by the susceptor may at a given time be no more than 5 (five) percent of the combined energy. This is possible in the melting of semi-conductor materials, for example. The energy absorbed by the susceptor easily reaches 30 percent or less of the combined energy at a given time during the melting process. This is less than any known stationary susceptor in the prior art. It is noted that the lower percentages are often only reached once the material in the crucible is fully molten or nearly so.

Figure 11:
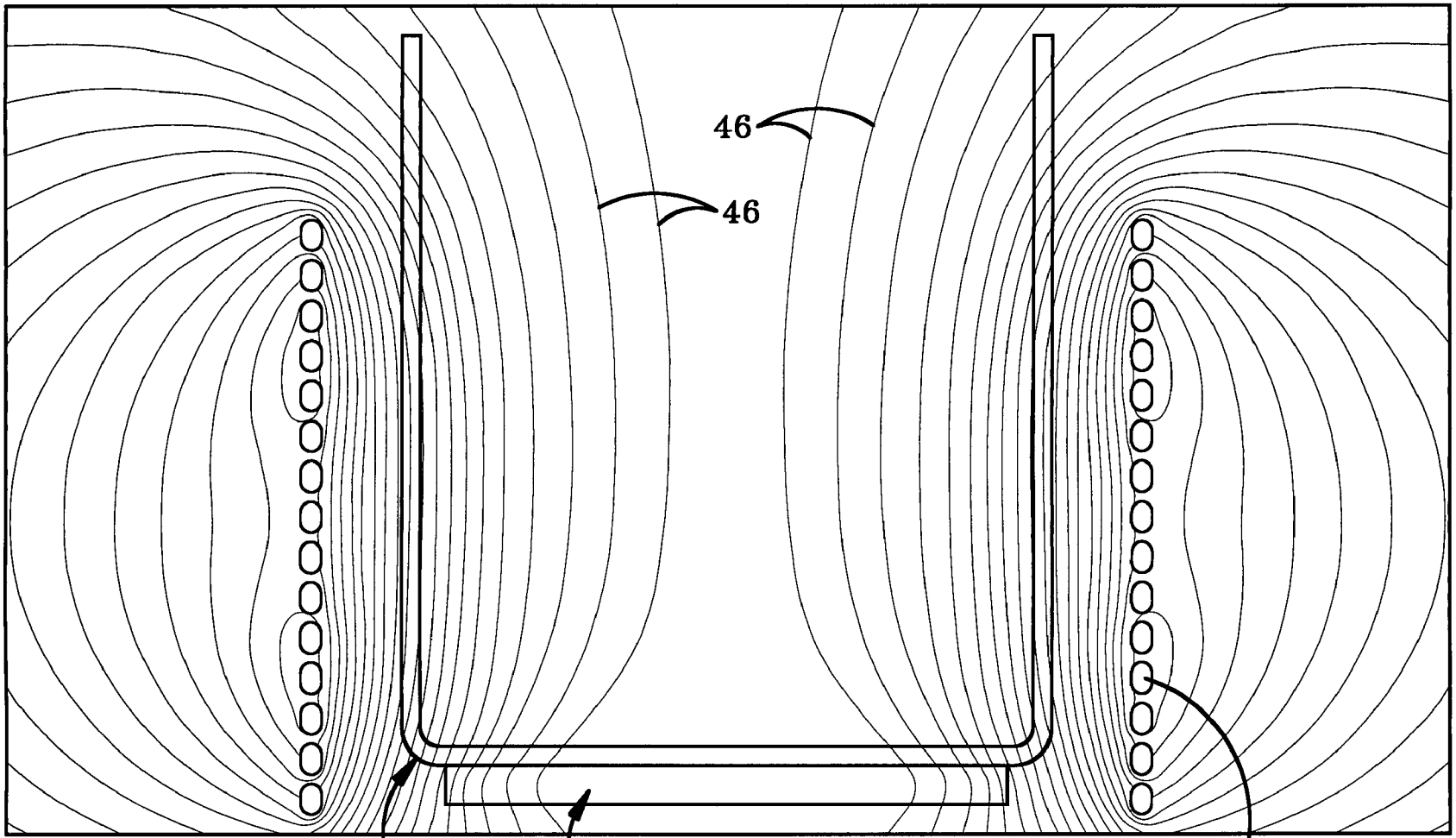
FIG. 11 is a diagrammatic view showing the distribution of the electromagnetic field created by the induction coil with respect to the crucible, the material to be melted therein and the conductive disk at an initial stage.

With reference to FIGS. 11-14, the pattern of the electromagnetic field produced by coil 18 is discussed along with the stirring patterns created within the molten material in crucible 22. With reference to FIG. 11, lines 46 indicate the pattern of the electromagnetic field produced by coil 18. As seen in FIG. 11, lines 46 are bent outwardly from the central portion of crucible 22 in the region of susceptor 24, in accordance with the natural tendency of the electromagnetic field to couple with an electrically conductive material, and particularly with the portion of that material closest to the coil producing the electromagnetic field. At the stage shown in FIG. 11, material 26 within crucible 22 does not affect the electromagnetic field or does so to such a minimal degree that it is not appreciable. At this point, inductive heating produced by coil 18 is for practical purposes within susceptor 24 only.

Figure 12:
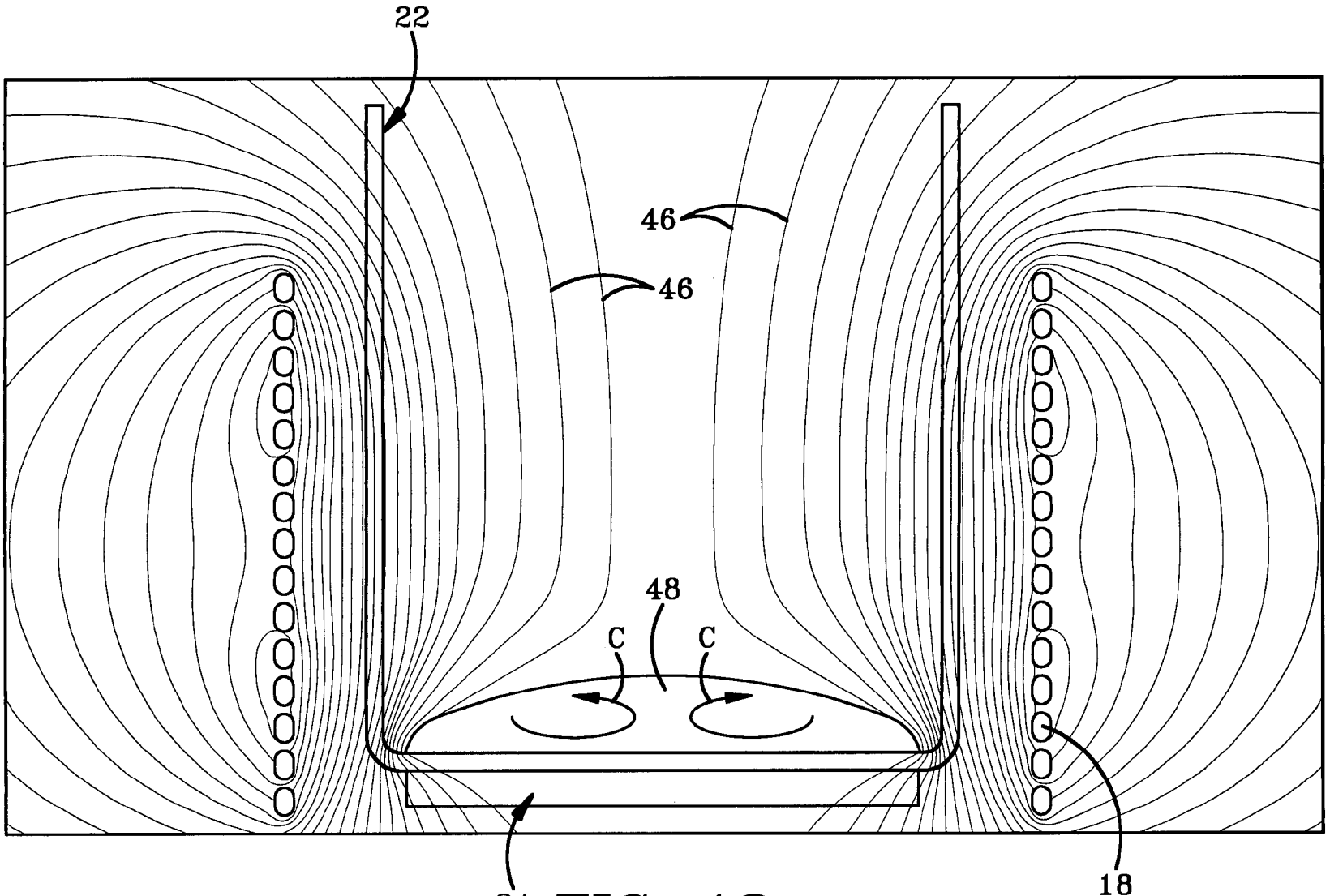
FIG. 12 is similar to FIG. 11 and shows a subsequent stage wherein a portion of the material within the crucible is molten and susceptible to inductive heating.

FIG. 12 shows a further stage of the process wherein a portion of the material has been melted as shown at 48. As clearly seen, lines 46 of the electromagnetic field are moved further outwardly and begin to concentrate on the outer perimeter of molten portion 48 and tend to follow along the upper surface of portion 48 as well. Simultaneously, the amount of energy as represented by lines 46 which passes through susceptor 24, has been reduced. FIG. 12 also shows the early stage of currents indicated by Arrows C, being formed within molten material 48, which are partly due to convection within molten material 48. Electromagnetic forces increasingly affect the stirring patterns, as discussed in further detail hereafter.

Figure 13:
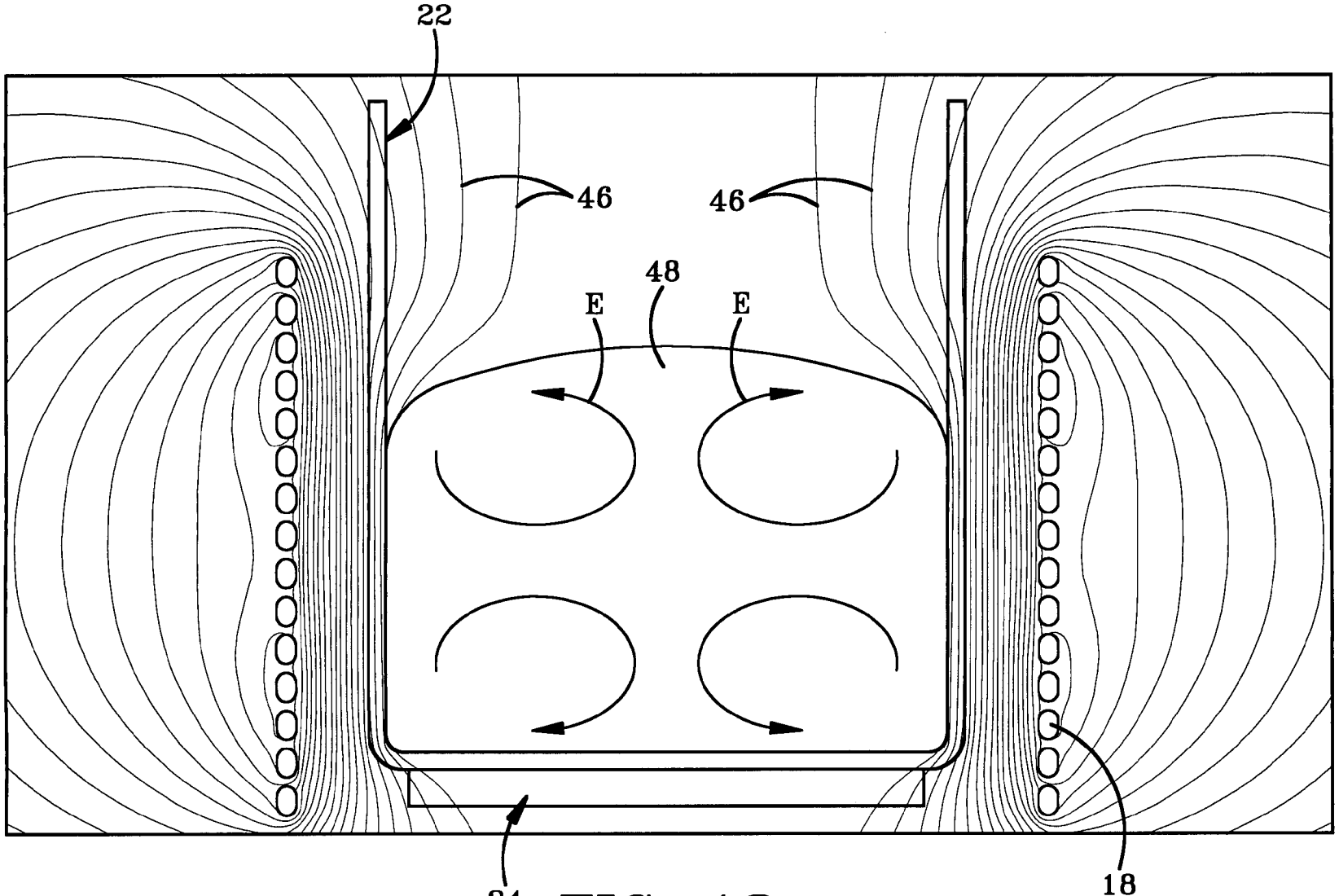
FIG. 13 is similar to FIG. 12 and shows the electromagnetic field distribution when most of the material is molten.

FIG. 13 shows yet a further stage of melting wherein a substantial portion of the material has been melted. Once again, the electromagnetic field as indicated by lines 46, has moved outwardly along the periphery of molten material 48. At this stage, the vast majority of energy used for inductive heating is being absorbed by molten material 48 and a relatively minimal amount is being absorbed by susceptor 24, as indicated by lines 46. In addition, eddy currents within the molten material are further indicated by Arrows E in FIG. 13. As indicated by Arrows E, the current within molten portion 48 is generally divided into an upper portion and a lower portion. In the upper portion, the molten material flows inwardly and upwardly towards the central upper portion of molten portion 48. In the lower portion, the material flows inwardly and downwardly towards the lower central portion of molten portion 48. As noted previously, electromotive forces are primarily responsible for the currents within portion 48, which is further detailed hereafter. The current flow pattern shown in FIG. 13 is known in the art as a "quadrature" flow pattern.

Figure 14:
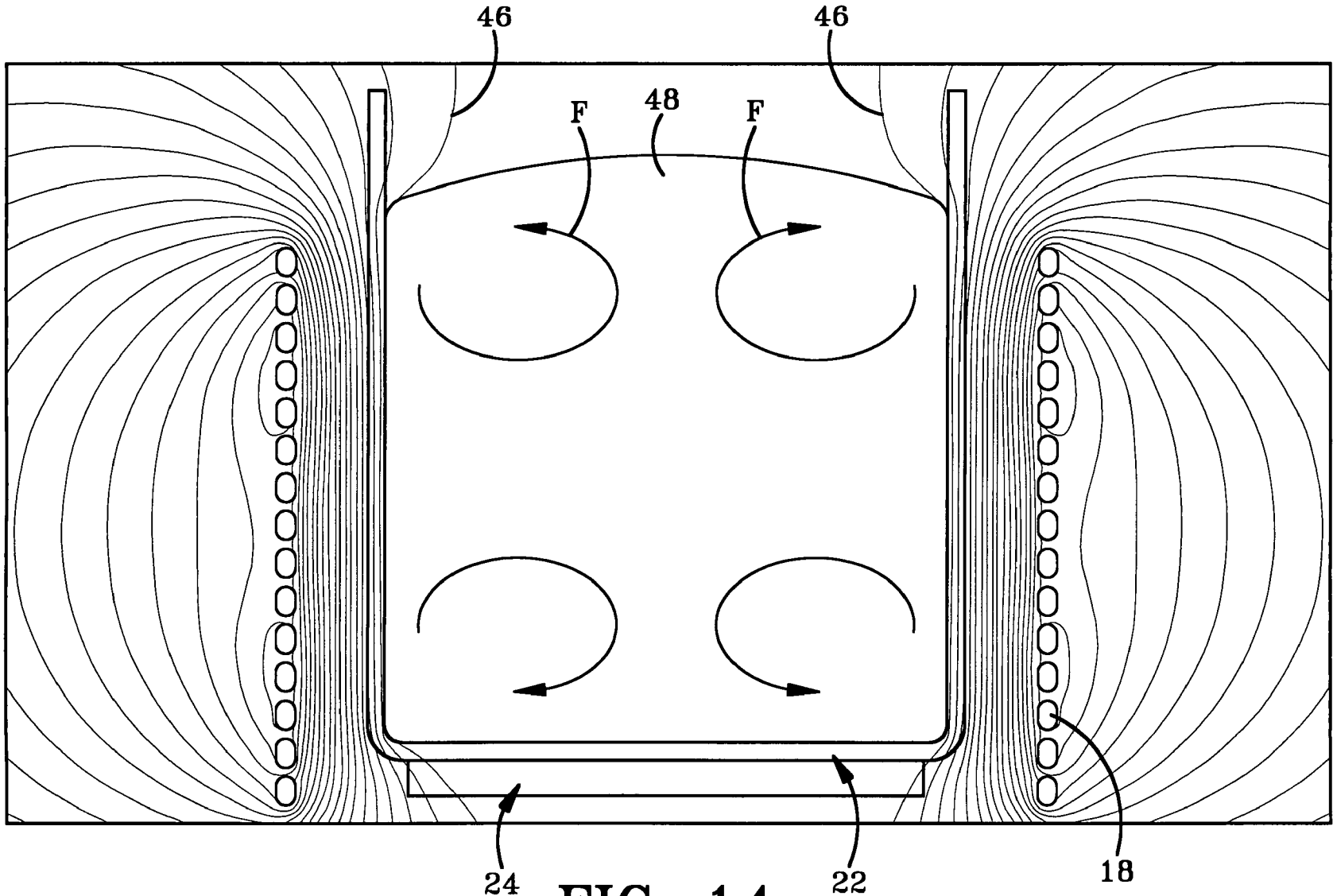
FIG. 14 is similar to FIG. 13 and shows the electromagnetic field distribution when the entire contents of the crucible are molten.

FIG. 14 shows all of the material in crucible 22 in a molten state and further shows the amount of energy being absorbed by susceptor 24 as being minimal and the amount of energy being absorbed by molten material as having substantially increased. FIG. 14 also shows that eddy currents (Arrows F) within the molten material follow the quadrature flow pattern.

As noted above, and with reference to FIG. 15, the electromotive forces created by the electromagnetic field of coil 18 push on molten material 48 in the direction of Arrows G. The electromotive forces indicated by Arrows G in the in central region, that is, those that are about halfway up the molten portion 48, exert a stronger force than those toward the top or the bottom portion of molten portion 48. This creates an electromagnetic force pinch effect whereby the molten material is literally moved inwardly away from side wall 30 of crucible 22.

Figure 15:
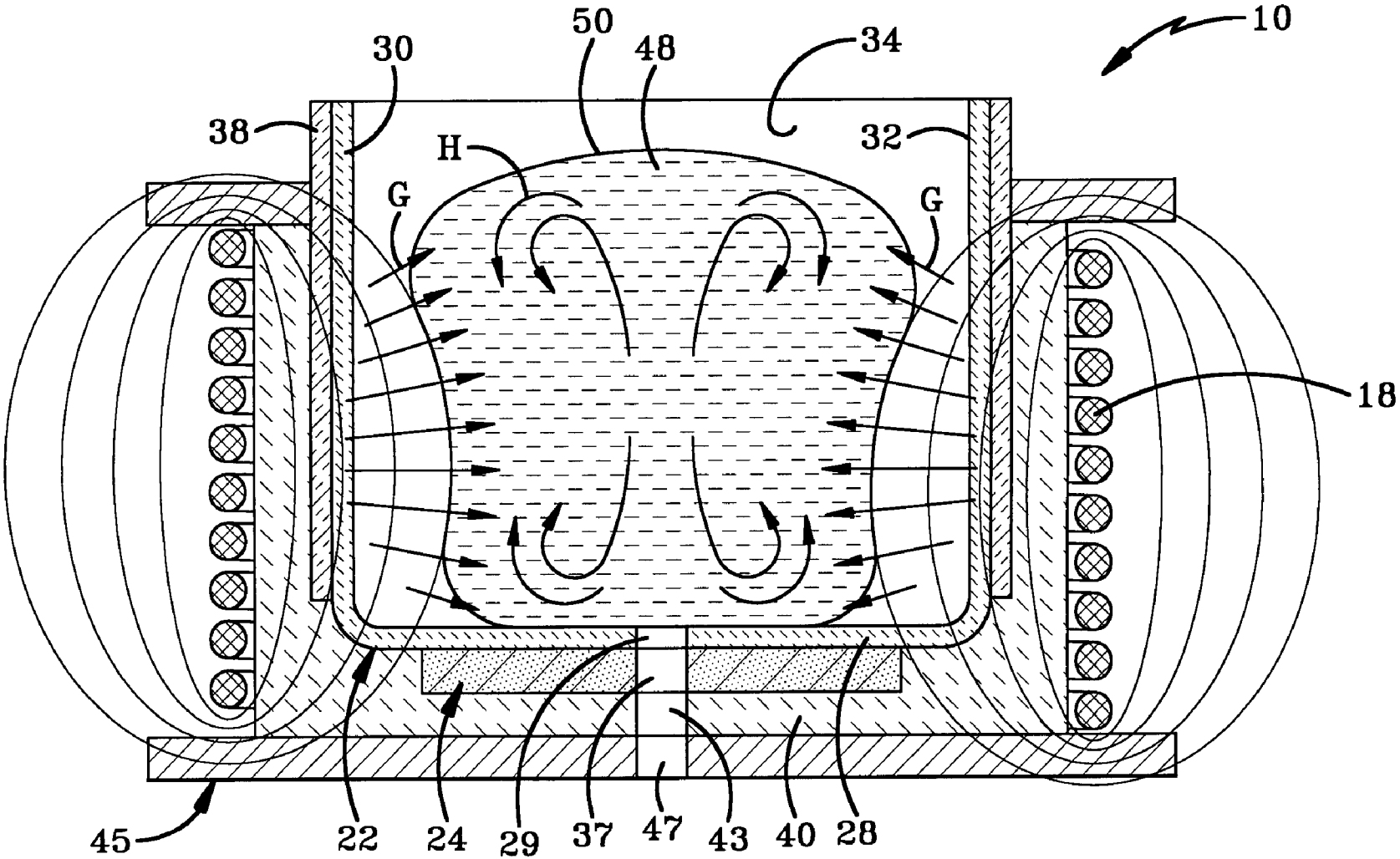
FIG. 15 is a diagrammatic sectional view wherein the entire contents of the crucible are molten and shows the physical effect of the electromotive pinch force and the resulting currents flowing within the molten material.

In addition, the difference in the strength of the electromagnetic forces as noted, causes the molten material to flow in the directions indicated by Arrows H, that is, in the quadrature pattern discussed above. Convection plays a role in these currents as well. As shown in FIG. 15, the electromotive forces and the currents produced in molten materials 48 create a positive meniscus 50 which can be fairly substantial. While the type currents produced and the positive meniscus described is generally known in the prior art, the increased effect of the electromotive forces on the molten material due to the configuration of susceptor 24, increases the velocity of the flow and the height of the meniscus. The increased velocity helps with the drawing of raw materials into the melt and helps produce a more uniform temperature throughout the melt. In addition, the higher meniscus creates a greater surface area atop the melt, and thereby provides greater opportunity for direct contact between molten material and solid material being added to the melt to expedite the drawing of raw material into the melt.

Figure 16:
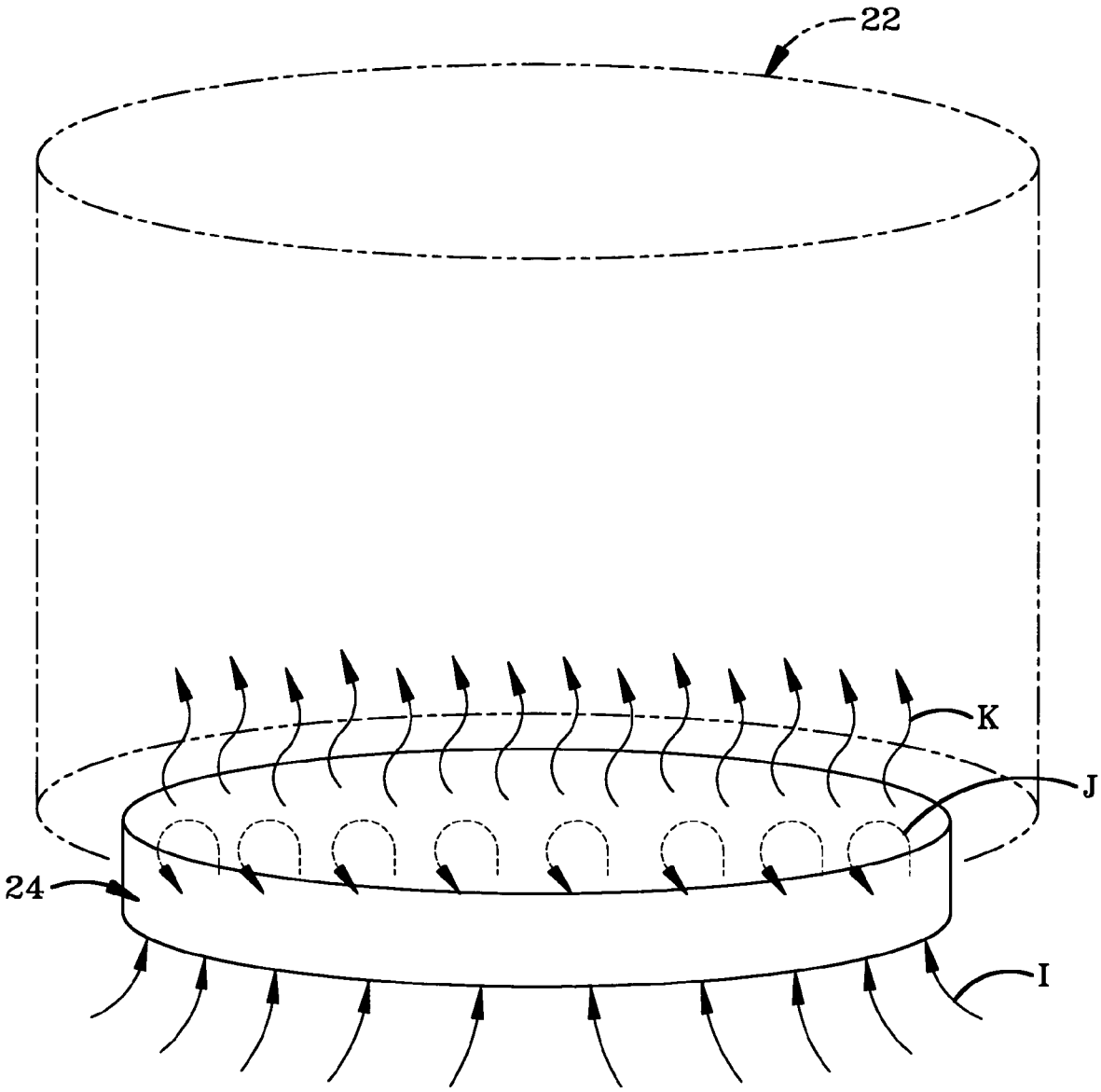
FIG. 16 is a diagrammatic view showing the electromagnetic field creating electrical current within the conductive disk and showing the upward transfer of heat to the crucible through conduction and radiation.

FIG. 16 shows the basic concept of induction heating as well as the transfer of heat from susceptor 24. In particular, Arrows I in FIG. 16 indicate the direction of the electromagnetic field which produces electrical currents shown by Arrows J in accordance with the well-known right-hand-rule regarding inductive currents. As previously discussed, once heat has been inductively produced in susceptor 24, heat is transferred as shown by Arrows K, by conduction and radiation through crucible 22 into materials 26 in order to initially melt the material. Of course, positioning the susceptor beneath the crucible is advantageous in that heat naturally rises.

Furnace 100, the second embodiment of the present invention, is shown in FIG. 17. Furnace 100 is similar to furnace 10 except that susceptor 24 is located inside melting cavity 34 of crucible 22 and is seated on bottom wall 28 thereof, although susceptor 24 may also be disposed upwardly from bottom wall 28 if desired. An optional protective liner 102 encases susceptor 24 to protect against the contamination of the melt by susceptor 24. In addition, refractory material 140 is altered in accordance with the changed location of susceptor 24 and defines a hole 143 through which molten material may flow, as with hole 43 of refractory material 40 of furnace 10.

Furnace 100 operates in the same manner as furnace 10 other than some relatively minor variations. For instance, the configuration of melting cavity 34 is effectively altered by the presence of susceptor 24 therein, which consequently varies the melting pattern somewhat. Where protective liner 102 is used, transferring heat from susceptor 24 to material within melting cavity 34 is hampered to some degree in comparison to using susceptor 24 without liner 102. However, even with liner 102, heat transfer to the material may be more effective in comparison to furnace 10 because heat need not be transferred through bottom wall 28 of crucible 22. In addition, where there is no concern of contaminating the melt with susceptor 24, protective liner 102 may be eliminated and heat transfer from susceptor 24 to the material is then direct. Locating susceptor 24 inside crucible 22 does expose susceptor 24 to higher temperatures due to the inductive heating of the molten material, which may shorten the life of susceptor 24. On the other hand, where susceptor 24 is seated on bottom wall 28, susceptor 24 may insulate bottom wall 28 from the heat from the molten material to some degree, thus adding to the life of the crucible.

A variety of changes may be made to furnaces 10 and 100 without departing from the spirit of the invention. For instance, coil 18 need not be substantially cylindrical in shape in order to properly function. However, the generally cylindrical coil in combination with the cylindrical side wall of crucible 22 and disk shape of susceptor 24, provides an efficient configuration for inductively heating susceptor 24 and material 26 in crucible 22. Further, the induction coil or induction member need not surround the crucible 22 in order for the basic concept of the invention to work. As long as an electromagnetic field is able to inductively heat susceptor 24 and materials 26 within crucible 22, and the induction member is closer to the material to be inductively heated than it is to susceptor 24, the basic process works in accordance with the inventive concept. Thus, the induction member need not be in the form of an induction coil, but may be any member which is capable of producing an electromagnetic field when an electric current passes through it. The illustrated configuration may be more pertinent for certain materials such as semi-conductor materials, which are highly refractory and require a substantial amount of energy to melt.

In addition, susceptor 24 or a similar susceptor may be positioned above the material to be melted. However, contamination of the melt with the susceptor itself may be an issue in certain circumstances. In addition, where there is a desire to prevent contact between the susceptor and the molten material, positioning the susceptor close enough to material to effect sufficient heat transfer becomes an issue. Further, a susceptor extending over a substantial portion of the material may inhibit adding additional material to the crucible. Also, since heat rises, positioning the susceptor above the material to be melted diminishes efficiency of heat transfer.

As noted previously, the susceptor is an electrically conductive material and is preferably graphite, although it may be formed of any suitable material. Further, the susceptor may be of a wide variety of shapes such as, for example, a cylinder, a doughnut, a sphere, a cube, or any particular shape in which an electrical circuit and heat may be formed by induction. Most importantly, the susceptor should be disposed farther from the induction coil than is the susceptible material within the melting cavity. Similarly, the crucible can also take a variety of shapes although the cylindrical shape is preferred as noted above.

Furnaces 10 and 100 show a very simplified bottom flow or bottom pouring concept. This is intended to represent any suitable configuration of a pouring mechanism through which molten material may flow from the crucible, whether a bottom flow, overflow or any other pouring mechanism known in the art.

Induction furnaces 10 and 100 thus provide efficient means for inductively heating materials which are not susceptible to inductive heating at generally lower temperatures and which become inductively heatable at higher temperatures, typically when the material is molten. As discussed earlier, semi-conductor materials, for example, silicon and germanium fall within this group. In addition, this process works well with materials which are normally electrically conductive at lower temperatures but which are in the form of sufficiently small particles whereby electricity will not flow from particle to particle due to the small contact point between adjacent particles. While it is generally desired to use particulate material, furnaces 10 and 100 may also be used to melt or heat larger pieces of material. As noted above, the present invention may also be used with fibrous materials or other materials having geometries which are particularly difficult to melt via inductive heating.

Certain liquids are also particularly suited to heating with the present invention, for example, those liquids which are not susceptible to inductive heating at a relatively lower temperature but which are susceptible to inductive heating at a relatively higher temperature. The invention is also suitable for heating liquids which are susceptible to inductive heating at relatively higher frequencies (i.e., higher frequency electrical current to the induction coil) at a relatively lower temperature and which are susceptible to inductive heating at relatively lower frequencies at a relatively higher temperature due to the corresponding lowered resistivity of the liquid at the higher temperature. This may include scenarios wherein such liquids are simply not inductively heatable at the relatively lower frequency when the liquid is at the relatively lower temperature. This may also include scenarios wherein such liquids are susceptible to inductive heating to some degree at the lower frequency and lower temperature, but only at a relatively lower efficiency, while this efficiency increases at the lower frequency when the temperature of the liquid is sufficiently raised. Thus, the invention is particularly useful in that the conductive member can heat such liquids to bring them into a temperature range where commercially feasible lower frequencies can be used to inductively heat the liquids, substantially increasing the efficiency of heating such liquids.

As previously described herein, induction furnaces 10 and 100 substantially accelerate the process of melting solid materials. However, this increased rate of melting and other factors present additional problems. Such problems exist in the process of melting solid material generally and more particularly with the melting of solid semi-conductor material, especially in a granular form. The problems and method for solving these problems is given subsequently with particular reference to the melting of solid semi-conductor materials although these problems and methods of solving them may apply equally as well to other materials. Some of the problems relate to the need to melt solid semi-conductor materials which may contain some form of moisture.

One problem is that the high power required to melt semi-conductor materials and other materials translates to high surface radiation thermal losses from the molten bath which in turn requires additional power to overcome these losses in order to melt the material. The high power provided via the induction coil during inductive melting of the material creates substantial electromotive forces which can propel molten material out of the crucible. This is particularly true when the molten material has a relatively light density, such as is the case with semi-conductor materials. Another problem is the loss of molten material due to chemical reactions within the molten material. For example, the melting of hydrogenated granular semi-conductor material leads to the release of hydrogen which causes excessive spitting of the molten material, leading to a significant loss of molten material from the crucible.

In accordance with the invention, the process for solving these problems is described with reference to FIGS. 18-29. As previously described in the present application, granular material is fed into the bottom of the crucible and the melting process is begun by inductively heating susceptor 24 with induction coil 18 and transferring heat from susceptor 24 to material 26 to form molten material 42. As molten material 42 is formed and with reference to FIG. 18, some of molten material 42 wicks upwardly into the spaces between the particulate material 26 to form a wicking layer 52 extending over the entire surface of molten material 42. Wicking layer 52 is thus a mixture of molten material and solid particulate material. At this initial stage of melting, solid material 26 disposed above wicking layer 52 insulates against thermal losses from molten material 42.

This process of heating and melting thus forms a bridge 53 which includes wicking layer 52 and most or all of solid material 26. Bridge 53 remains relatively thin throughout the melting process. One of the reasons that the thickness of bridge 53 is kept to a minimum is to ensure that the melting process can continue in an efficient manner. If the bridge is too thick, then heat is absorbed throughout the bridge and may prevent or severely hinder the melting of the solid material. For the purposes of this application, bridge 53 has, at the stage indicated in FIG. 18, a thickness T1 in the vertical direction extending between an upper surface 56 of solid material 26 and an uppermost surface 55 of molten material 42, said uppermost surface 55 being at the top of meniscus 50. Uppermost surface 55 of molten material 42 is also the uppermost lower surface of wicking layer 52. For the purposes of the present application, bridge 53 has a horizontal width W1 defined between opposed points 57A and 57B on an outer perimeter of wicking layer 52, said points 57A and 57B typically being diametrically opposed since bridge 53 will typically be substantially circular when viewed from above. As will be discussed further below in more detail, width W1 far exceeds thickness T1 of bridge 53; analogous widths and thicknesses of bridge 53 during the melting process are likewise. This is certainly true once molten material 42 and wicking layer 52 extend outwardly to the degree shown in FIG. 18 and at subsequent times during the melting process. By way of example, width W1 is approximately 15 times as great as thickness T1. Upper surface 56 is also the upper surface of bridge 53. At this early stage of melting, upper surface 26 of bridge 53 is at a height H1 within crucible 22. Thus, bridge 53 and upper surface 26 thereof at this early stage of melting is disposed adjacent bottom wall 28 or a lower end of crucible 22 and distal a top 59 of crucible 22.

Figure 19:
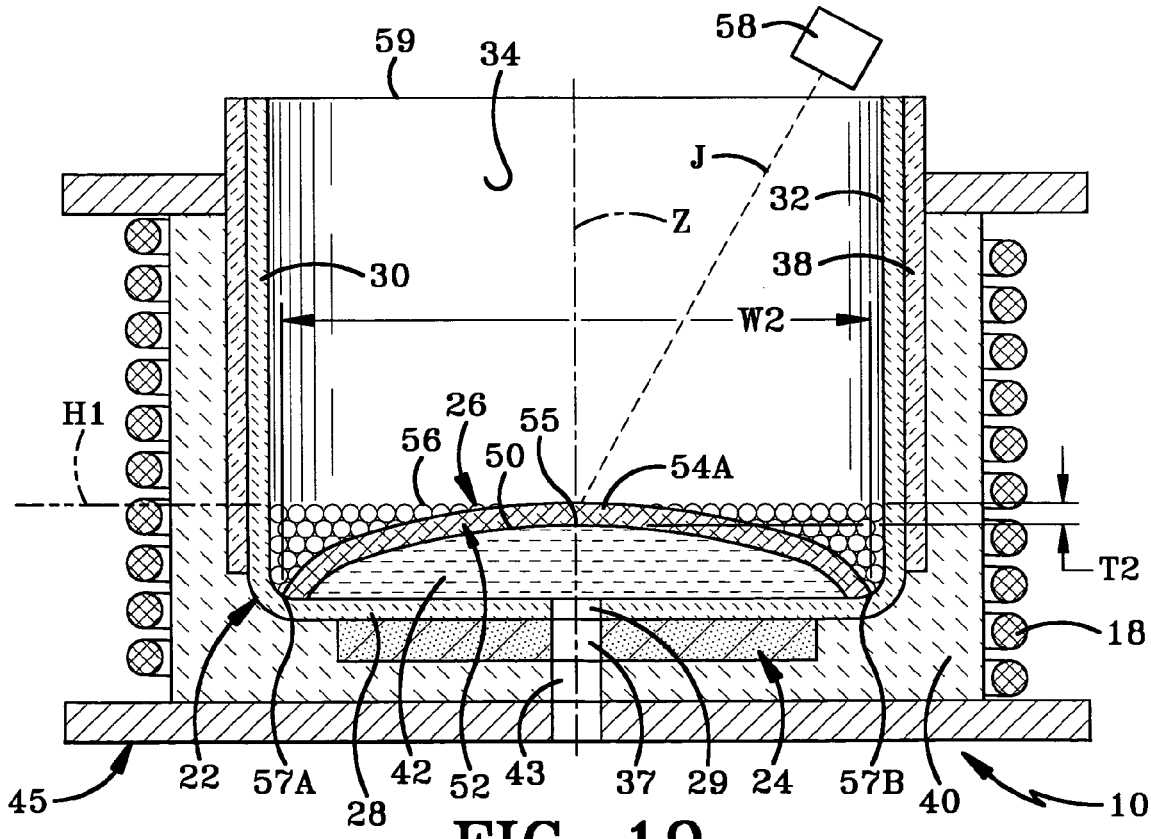
FIG. 19. is similar to FIG. 18 and shows a subsequent stage of melting wherein a wicking portion of the wicking layer has moved upwardly sufficiently to be discernable.

As heating of the material continues, portions of solid material 26 of bridge 53 are melted whereby the amount of molten material 42 increases and wicking layer 52 continues to rise into the particulate material 26 disposed thereabove. At a certain point, as seen in FIG. 19, a wicking portion 54A of wicking layer 52 nears or reaches upper surface 56 of solid material 26. As wicking portion 54A nears or reaches surface 56, it becomes discernable at a wicking time and is sensed by a sensor 58, with the sensing of material indicated at dashed line J in FIG. 19. Sensor 58 may be positioned in any suitable location in order to sense wicking portion 54A. In addition, sensor 58 may be a person who visually senses wicking portion 54A or may be any sensing device suitable for this purpose. Because molten material 42 and wicking portion 54A may glow due to the substantial heat thereof, as is the case with semi-conductor materials, wicking portion 54A may be optically sensed. However, other molten materials forming a wicking portion 54A may not glow and thus may be sensed by a heat sensing device, which is also of course applicable to materials which may also be optically sensed. Thus, one preferred sensor 58 is a tempo-optical instrument which can sense heat and/or light in order to discern wicking portion 54A.

Figure 18:
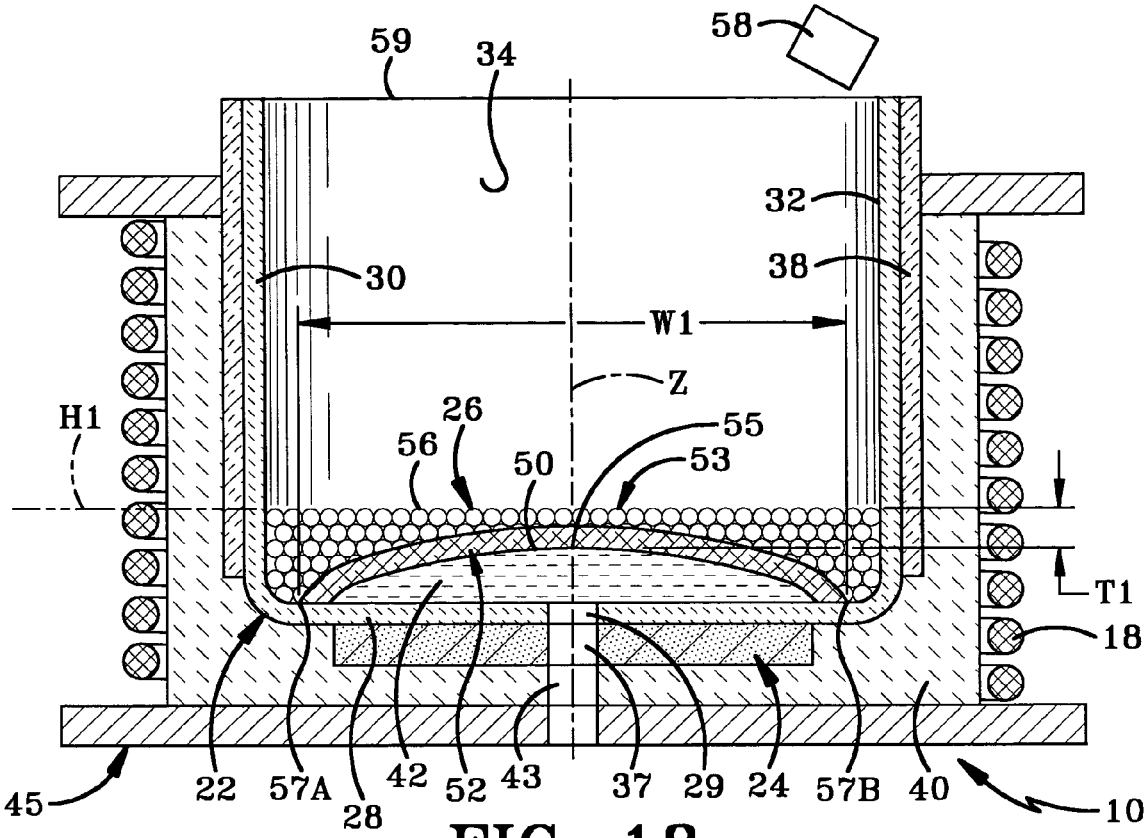
FIG. 18 is similar to FIG. 4, showing a similar stage of the melting process and further shows a wicking layer of the molten material wicking upwardly into the bridge and a sensor disposed above the melting crucible.

At the stage of the melting process indicated in FIG. 19, bridge 53 has a thickness T2 which is smaller than thickness T1 shown in FIG. 18 due to the melting of a portion of solid material 26 to increase molten material 42 and move wicking layer 52 upwardly so that thickness T2 corresponds substantially to the thickness of wicking portion 54A, which represents a central portion of layer 52 adjacent central axis Z. Thus, the melting of a portion of bridge 53 has thinned the bridge. Bridge 53 at this stage also has a width W2 defined in the same manner as previously discussed such that width W2 is greater than the width W1 due to the increased amount of molten material 42 and wicking layer 52 extending outwardly closer to inner surface 32 of side wall 30 of crucible 22. Again by way of example, width W2 is approximately 27 times as great as thickness T2.

Figure 20:
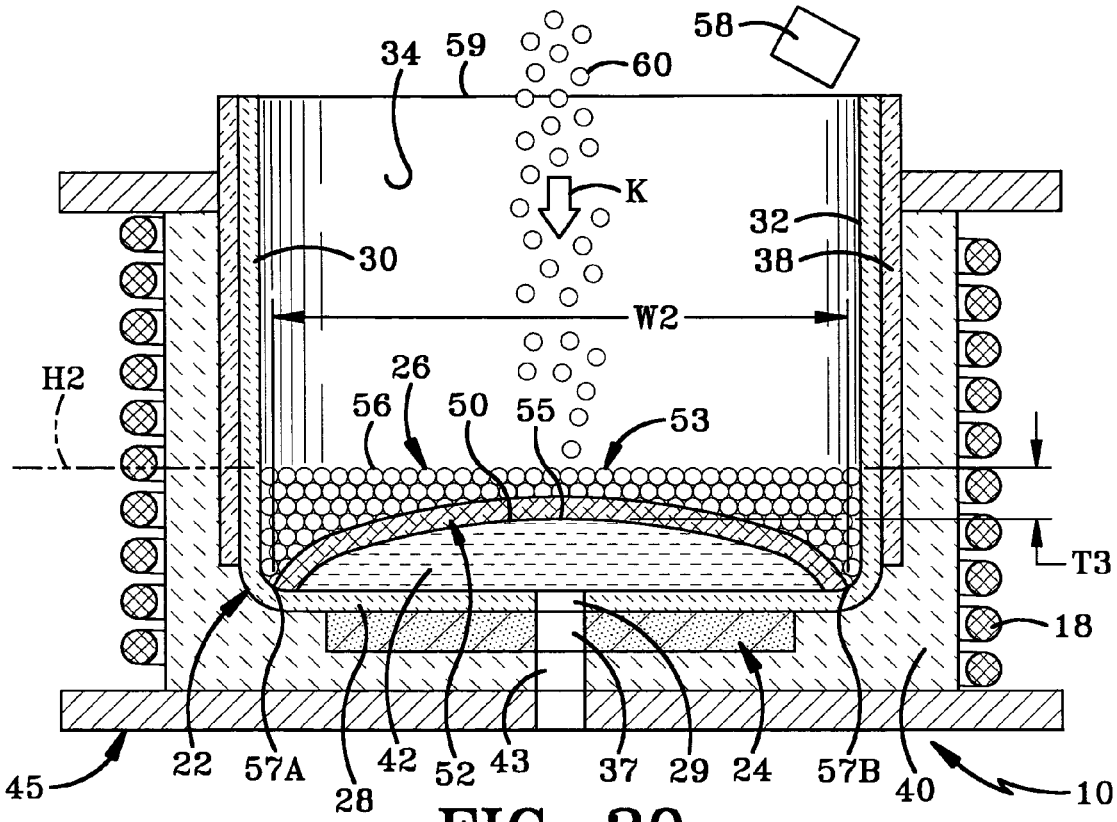
FIG. 20 is similar to FIG. 19 showing a further stage in which additional solid material is added atop the wicking portion to cover the wicking portion.

Once wicking portion 52 has been sensed by sensor 58, and with reference to FIG. 20, additional material 60 is added to the crucible as indicated by Arrow K. More particularly, material 60 is added at an adding time to cover wicking portion 54A so that there is no portion of wicking layer 52 which can be sensed by sensor 58, that is, wicking portion 54A is no longer discernable. Preferably, the adding time is immediately after the wicking time (when wicking portion 54A is discerned) to minimize heat loss from wicking portion 54A of molten material 42. The addition of material 60 increases the thickness of bridge 53 so that it has a thickness T3 which is greater than T2. Compared to thickness T1 of FIG. 18, thickness T3 of FIG. 20 is represented to be larger than thickness T1 although this may vary depending on the amount of material 60 added. Thus, the thickness of bridge 53 will vary during the process due to the addition of solid material and the melting of portions of bridge 53. More particularly, the adding of solid material and melting of portions of bridge 53 causes bridge 53 to alternately thicken and thin and cause bridge 53 to gradually move upwardly during the melting process. As shown in FIG. 20, upper surface 56 of bridge 53 has moved to a height H2 which is higher than height H1 of FIGS. 18-19, thereby representing in part this upward movement of bridge 53. As bridge 53 moves upwardly, the material of which it is composed gradually changes due to the addition of solid material thereto and melting of portions thereof.

Figure 21:
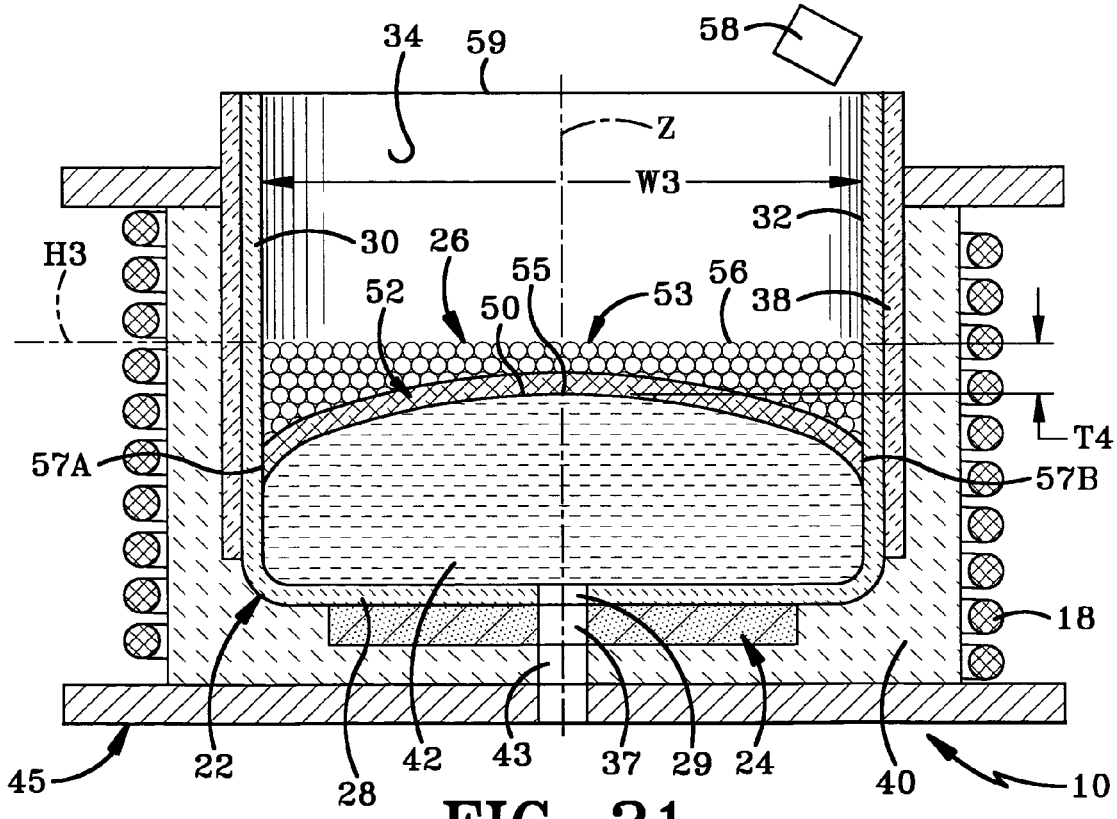
FIG. 21 shows a later stage of melting at a time when the molten material is primarily being heated inductively in a direct fashion by the induction coil.

Thus, a layering method is used wherein material is melted for a time sufficient to allow wicking portion 54A to be sensed at a wicking time, whereupon additional material is added to cover wicking portion 54A and the process is repeated. During the earlier stages of the melting process, the material within crucible 22 is heated either totally or primarily by transference of heat from susceptor 24 as previously described. As the layering method continues and the level of molten material increases within crucible 22, molten material 42 is inductively coupled to induction coil 18 so that at some point during the melting process, molten material 42 is primarily inductively heated directly by coil 18 while only a relatively small portion of heat is being inductively created in susceptor 24 and transferred to molten material 42. This stage is represented in FIG. 21, at which point bridge 53 has a thickness T4 and a width W3. Thickness T4 is slightly larger than thickness T3, but this is noted primarily to further indicate that the thickness of bridge 53 varies throughout the melting process. Once wicking layer 52 has moved outwardly to contact inner surface 32 of side wall 30 of crucible 22, the width of bridge 53 remains at width W3 as long as bridge 53 is maintained during the melting process. The width may vary for crucibles with inner perimeters which vary vertically. Once again by way example, width W3 is over 9 times that of thickness T4. Thus, it will be appreciated that while the ratio between the width and thickness of bridge 53 may vary, the width typically remains far greater than the thickness. This is in keeping with the desire to keep the thickness of bridge 53 to a minimum while limiting thermal loss from molten material 42 and preventing expulsion of molten material from melting cavity 34 of crucible 22, whether due to electromotive forces, chemical reactions or other causes. At the intermediate stage of melting shown in FIG. 21, upper surface 56 of bridge 53 is at a height H3 which is higher than height H2 of FIG. 20, in accordance with the upward movement of bridge 53.

Figure 22:
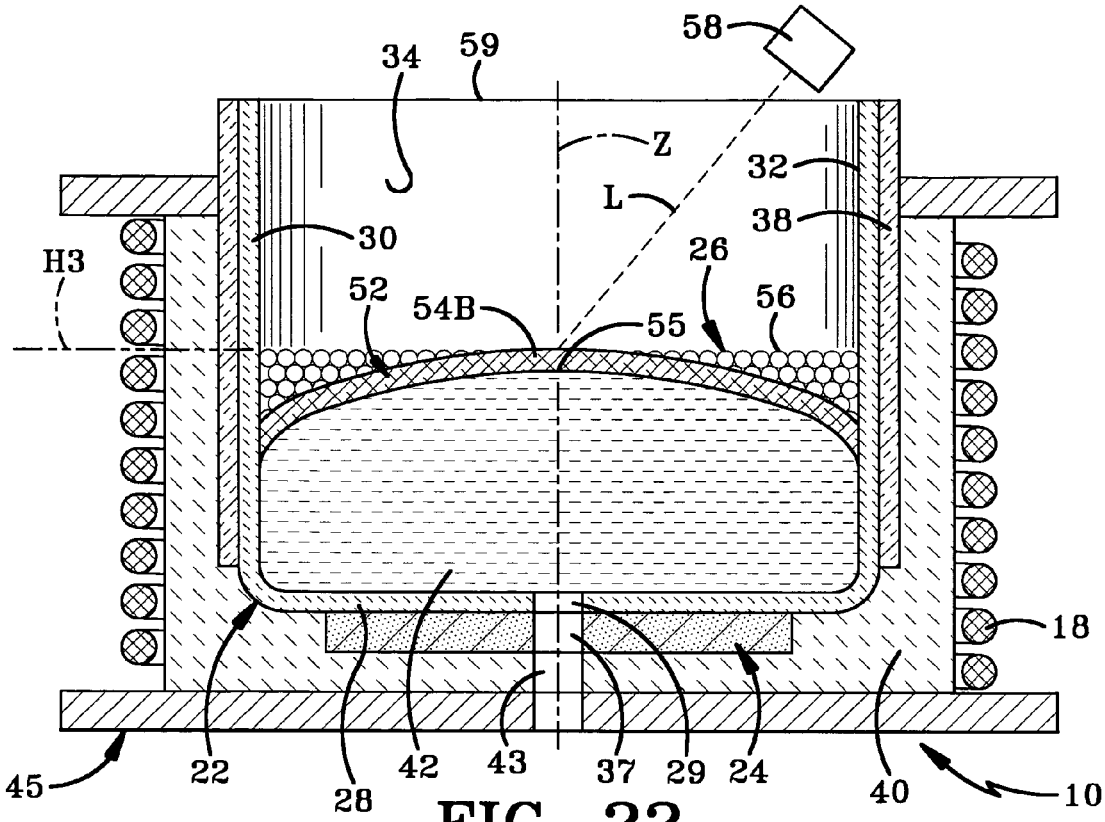
FIG. 22 is similar to FIG. 21 and shows a subsequent stage wherein a wicking portion of the wicking layer is discernable and sensed by the sensor.
Figure 23:
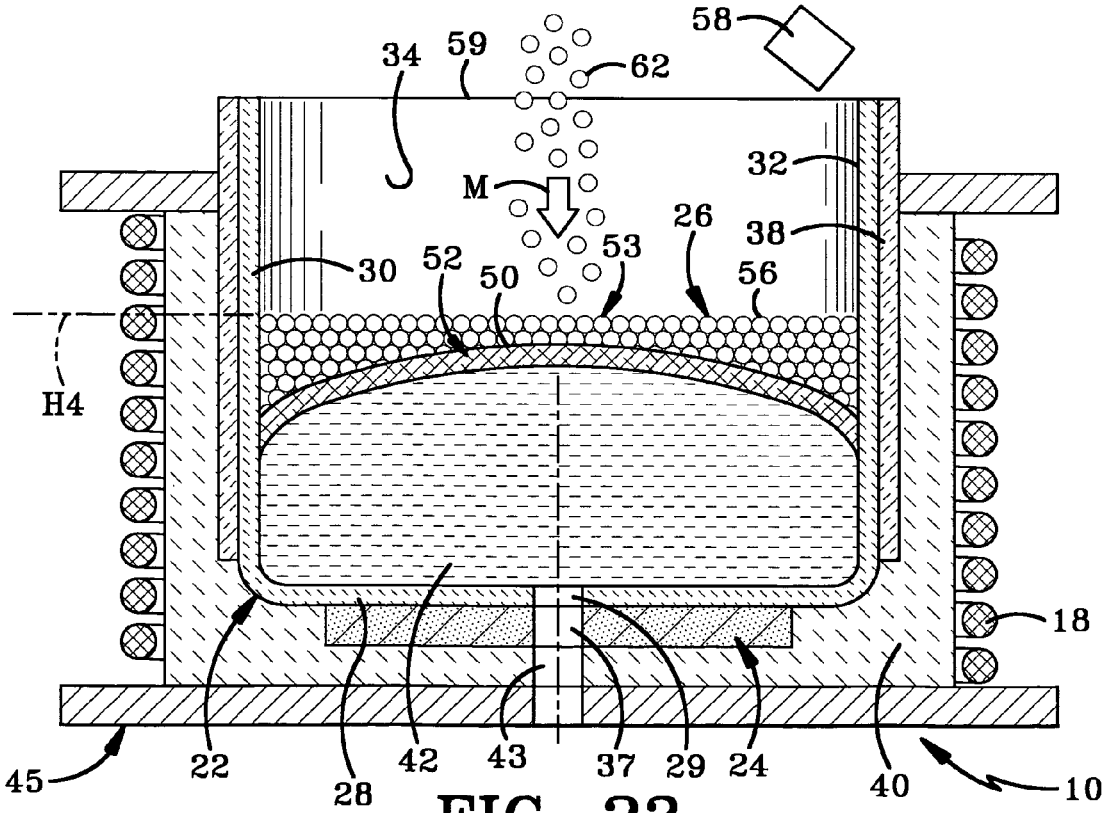
FIG. 23 is similar to FIG. 22 and shows a subsequent stage with additional material being added to cover the wicking portion.
Figure 24:
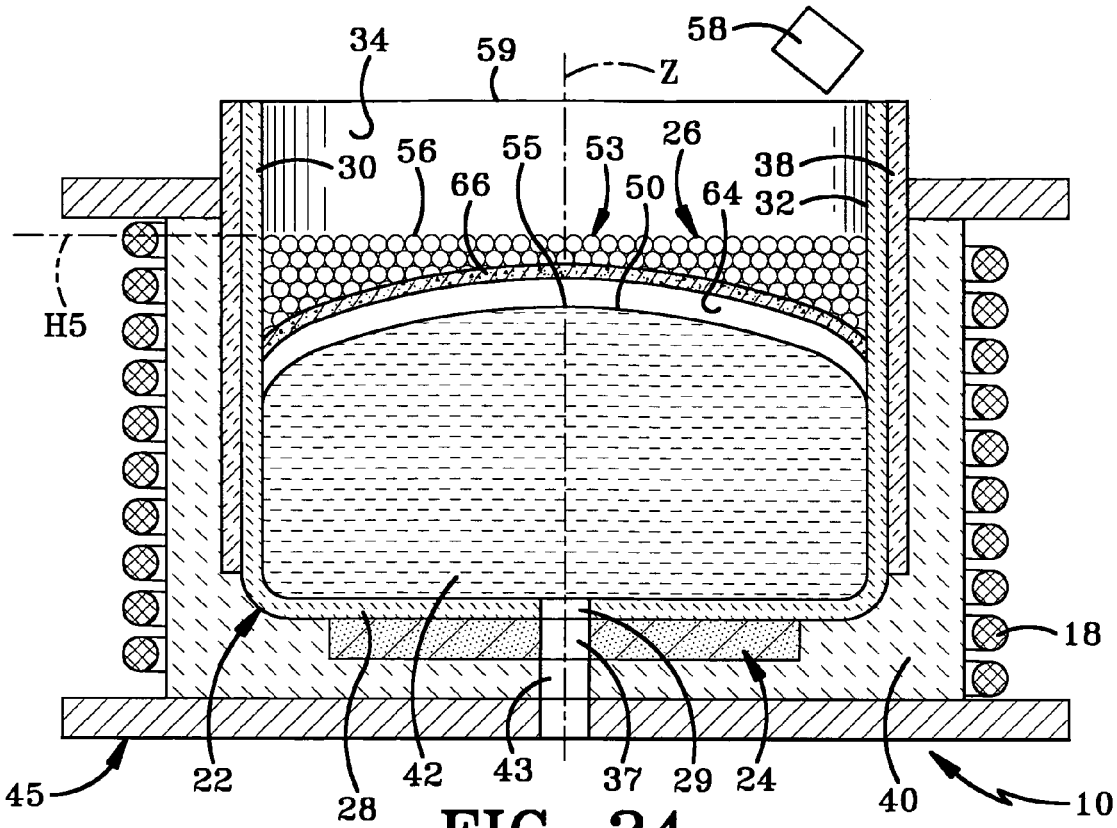
FIG. 24 is similar to FIG. 23 and shows a later stage in which the bridge is spaced upwardly from the molten material.

Molten material 42 is then inductively heated by conduction coil 18 so that a subsequent wicking portion 54B becomes discernable and is sensed by sensor 58 as indicated at dashed line L in FIG. 22. Once wicking portion 54B is sensed and with reference to FIG. 23, additional material 62 is added as indicated at Arrow M to cover wicking portion 54B as previously described with regard to wicking portion 54A. Upper surface 56 of bridge 53 has reached a height H4 in FIG. 23 which is higher than height H3 in FIGS. 21-22 in accordance with the upward movement of bridge 53. While the layering method may continue during the direct inductive heating of molten material 42, often this layering method is halted not long after molten material 42 becomes primarily inductively heated. Once the molten material is being directly inductively heated and susceptor 24 is absorbing very little energy from the magnetic field produced by induction coil 18, the greatly increased efficiency of the inductive heating substantially increases the heating rate of the molten material so that care must be taken to prevent superheating of the molten material.

Semi-conductor materials and certain other materials have a density when molten that is greater than when the material is solid so that the volume of a given portion of the material when molten is less than when solid. Thus, with reference to FIG. 24, when such a material is being melted, a space 64 is formed between molten material 42 and bridge 53. Space 64 insulates bridge 53 from the heat of molten material 42 so that the molten material previously found in wicking layer 52 solidifies to form a solid layer 66 in place of wicking layer 52 so that bridge 53 includes solid layer 66 and raw solid material 26 thereabove which has not yet been melted. Due to the insulative nature of space 64, the ability to melt new material is either eliminated or severely reduced unless a different tack is taken. To that effect, and in accordance with the invention, a hole is then formed in bridge 53 to allow additional material to be fed onto molten material 42, as further detailed below. It is further noted that FIG. 24 indicates that bridge 53 has continued to move upwardly whereby upper surface 56 thereof is at a height H5 which is higher than height H4 of FIG. 23.

Figure 25:
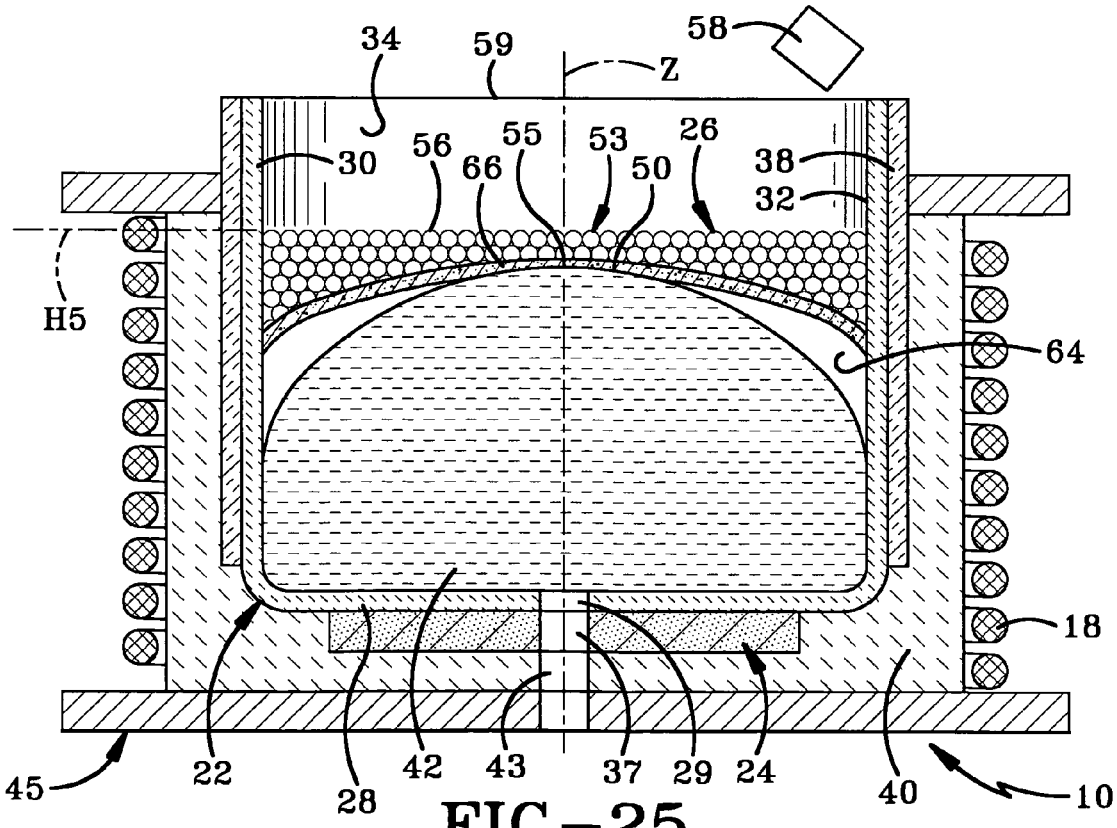
FIG. 25 is similar to FIG. 24 and shows a subsequent stage wherein power to the induction coil has been increased to heighten the meniscus of the molten material to begin melting a hole in the bridge.
Figure 26:
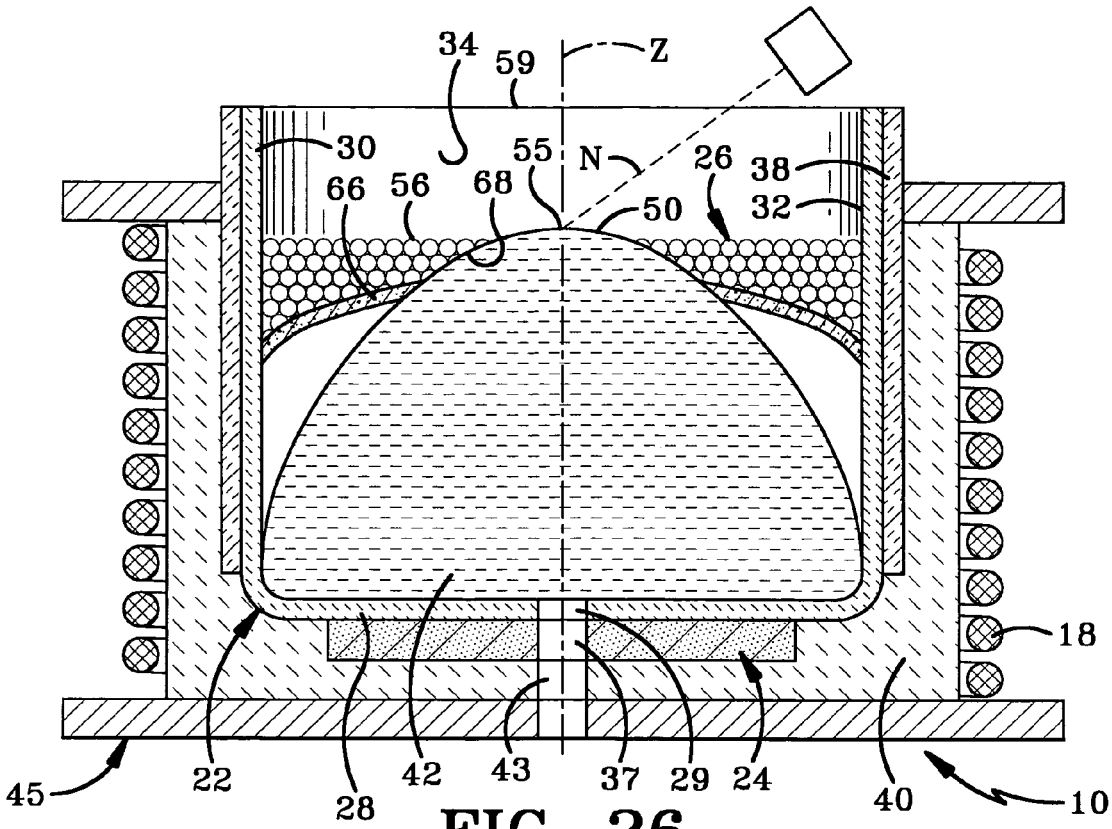
FIG. 26 is similar to FIG. 25 and shows a subsequent stage wherein the molten material has melted a hole through the bridge.

One method of forming a hole in bridge 53 is shown in FIGS. 25 and 26. In this method and with reference to FIG. 25, power source 20 (FIG. 1) is operated to increase the power to induction coil 18 in order to increase the electromotive forces within molten material 42 to increase the meniscus effect or increase the height of meniscus 50 to contact solid layer 66 and begin melting layer 66 in a central area of bridge 53. FIG. 26 shows molten material 42 melting through layer 66 and raw material 26 of bridge 53 to form a hole 68 as power to induction coil 18 is further increased to further heighten meniscus 50 of molten material 42. The glow and/or heat of molten material 42 is sensed by sensor 58 as indicated at N in FIG. 26. Most often, hole 68 may be formed by this method. However, if bridge 53 becomes too thick or for some other reason this method does not succeed at forming hole 68 an alternate method may be used.

Figure 26A:
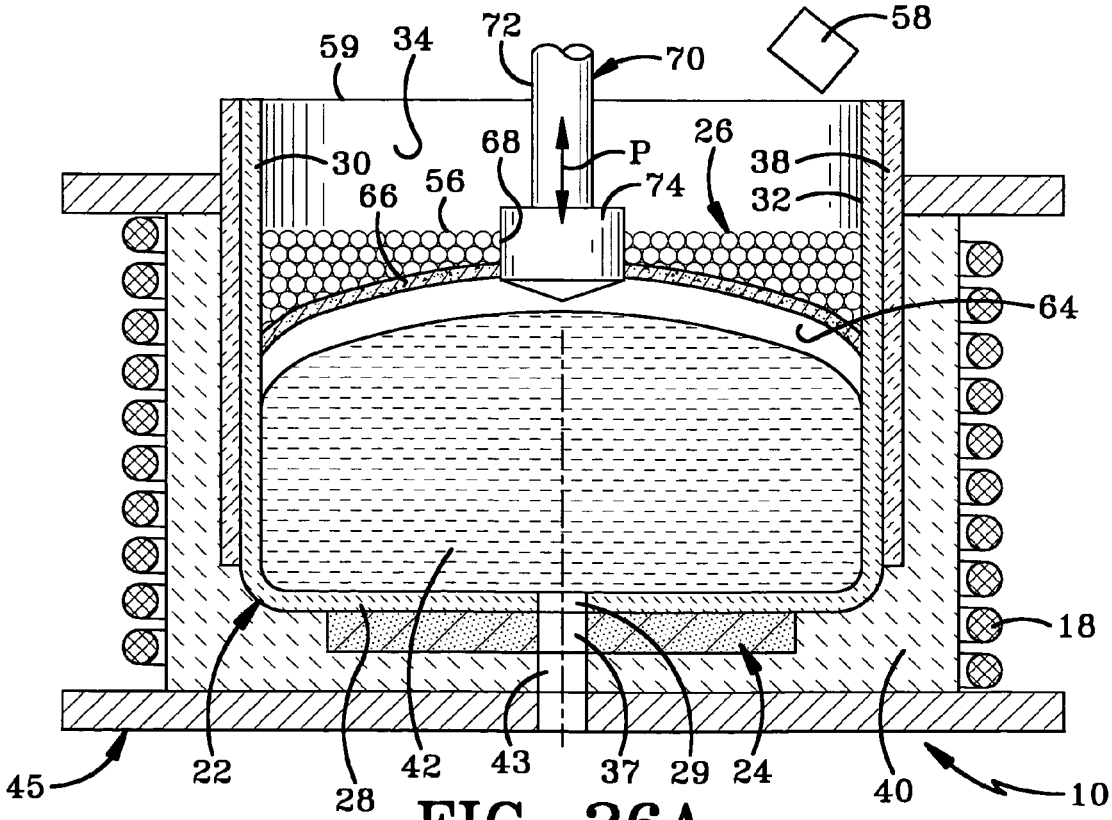
FIG. 26A is similar to FIG. 24 and shows an alternate method of forming a hole in the bridge by contacting the bridge with a bridge breaker.

With reference to FIG. 26A, an alternate method of forming hole 68 is shown. More particularly, a bridge breaker 70 is moved downwardly and then upwardly as indicated at Arrow P in order to contact bridge 53 to form hole 68. While any suitable bridge breaker may be used to this effect, one example of bridge breaker 70 which is particularly useful in the melting of semi-conductor materials, especially silicone, includes a stainless steel rod 72 with a silicone tip 74 wherein the silicone tip 74 is used to contact bridge 53 so as not to contaminate the melt. Similarly, where bridge 53 is formed of another material, at least the portion of the bridge breaker which is used to contact bridge 53 is preferably made of the same material as bridge 53 to prevent contamination of the melt.

Figure 27:
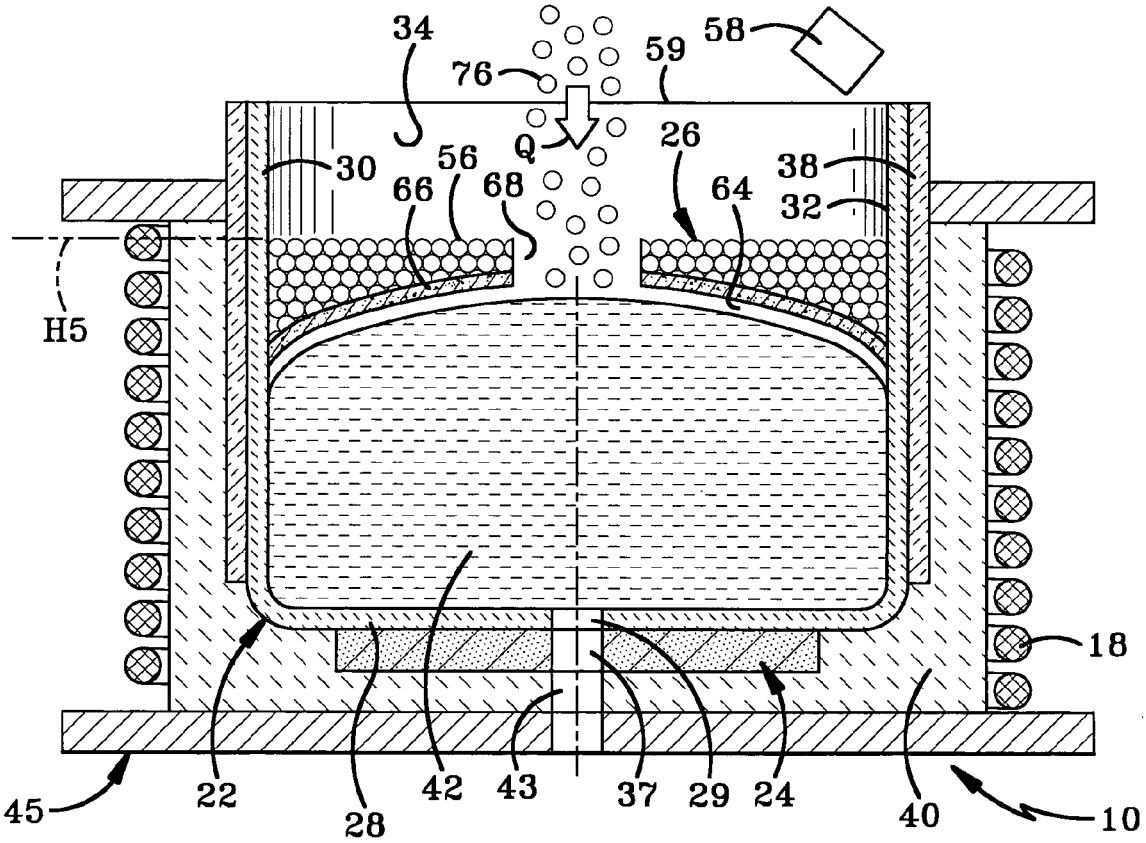
FIG. 27 shows a subsequent stage with additional material being added through the hole of the bridge.

With reference to FIG. 27, once hole 68 is formed, additional material 76 is added through hole 68 as indicated by Arrow Q as power to induction coil 18 is reduced and the meniscus effect is likewise reduced. It is noted that the additional material added through hole 68 may be charged into the crucible in such a manner as to form a funnel shape hole 68 wherein the added material is built up along the sides of the hole along its angle of repose. Prior to this point, bridge 53 has been maintained substantially throughout the melt without hole 68 formed therein. At the stage indicated in FIG. 27, bridge 53 with hole 68 formed therein is still maintained for a certain period, thereby continuing to reduce thermal heat loss from molten material 42, as well as prevent molten material 42 from being propelled from crucible 22 due to either electromotive forces or chemical reactions and so forth. The stirring effect produced by the electromotive forces nonetheless remains substantial and this allows for relatively rapid addition of raw material in order to continue the melting process in an efficient manner. It is clarified at this point that regardless of whether a space such as space 64 is formed between molten material 42 and bridge 53, it may be desirable to form a hole such as hole 68 or to feed additional material directly onto molten material 42. If at any time during the melting process hole 68 becomes closed, it must be reopened if additional material is to be added directly onto molten material 42.

Figure 28:
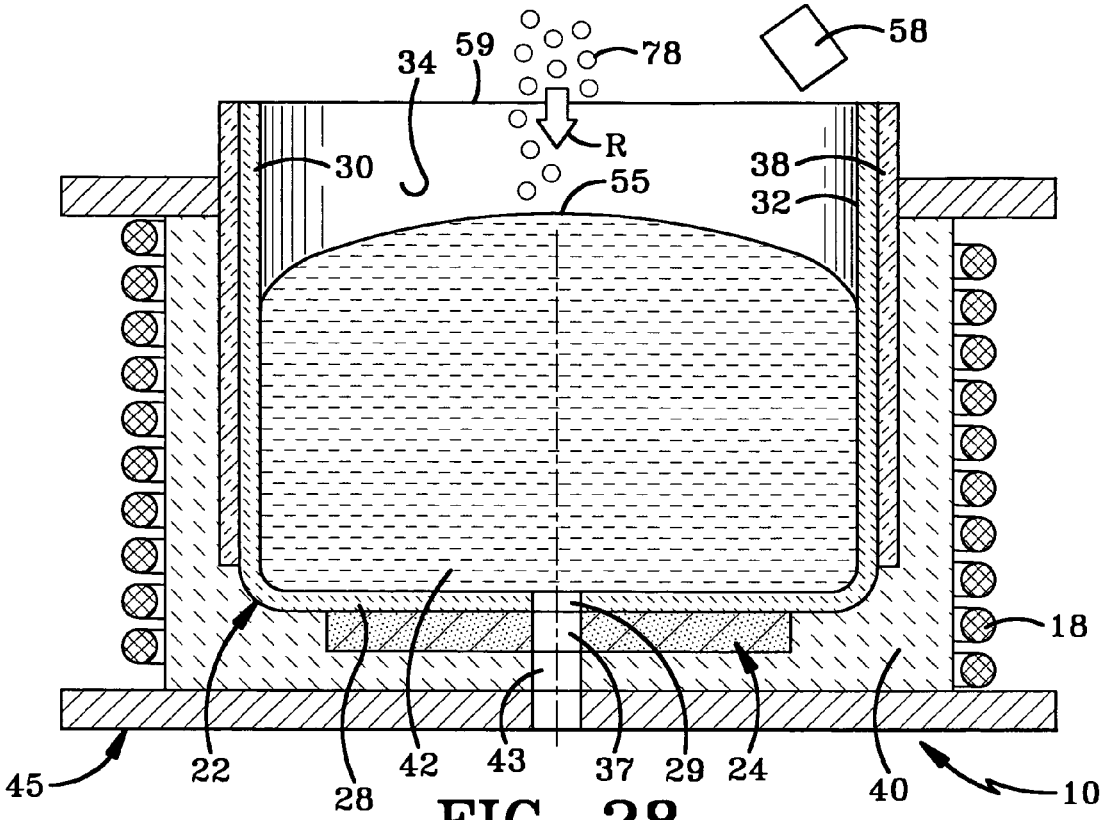
FIG. 28 shows a subsequent stage wherein the bridge has been melted out and additional material is being added to the molten material.
Figure 29:
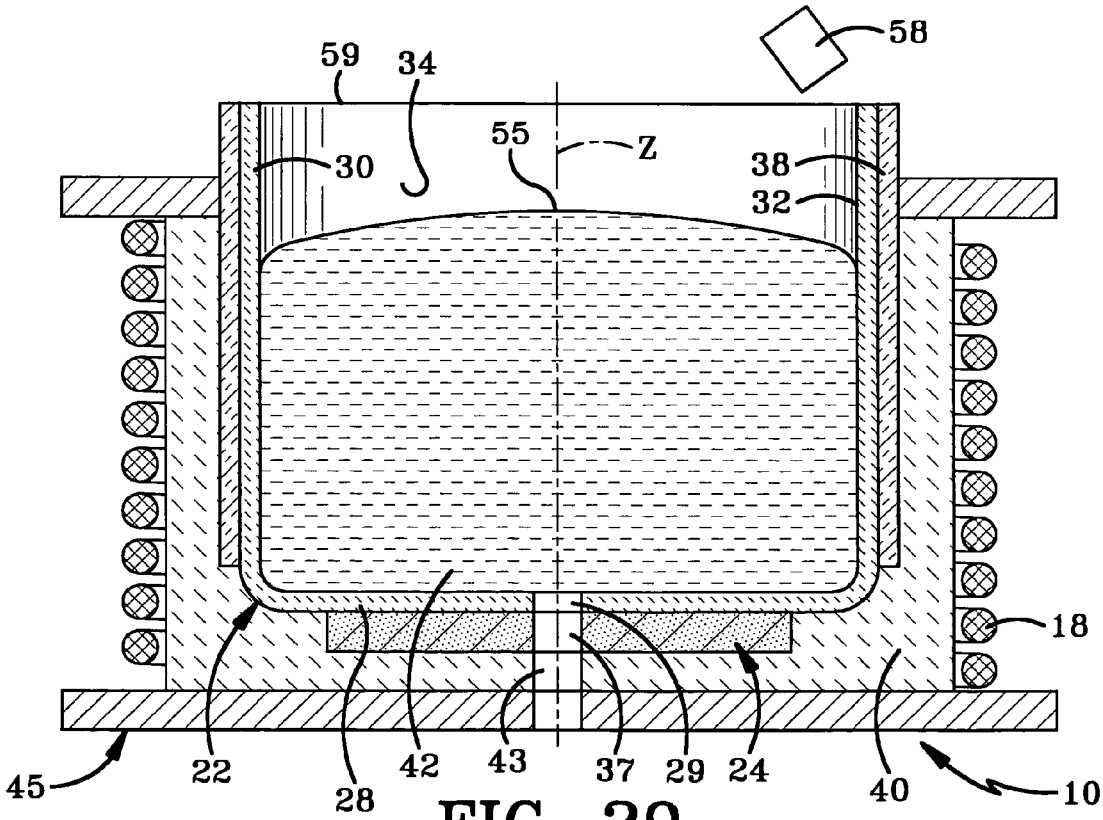
FIG. 29 shows a final stage of the melting process with the molten material at a full-rated capacity of a molten material with respect to the melting crucible.

Additional material is added to molten material 42 so that the amount of molten material 42 is increased and the level thereof rises within the crucible. As the level of molten material 42 rises, it will contact bridge 53 and begin melting bridge 53 once again. If the process of melting bridge 53 is not efficient or is otherwise undesirable at a lower power of induction coil 18, the power to induction coil 18 may be increased in order to increase the melting rate and/or to increase the meniscus effect as previously described in order to facilitate the melting of bridge 53. In any case, bridge 53 is at some point completely melted out as indicated in FIG. 28. Bridge 53 is typically melted out after molten material 42 reaches a large enough volume so that the electromotive forces do not propel molten material 42 out of crucible 22. Often, bridge 53 is melted out when molten material 42 has nearly reached a full rated capacity of the molten material with respect to the crucible. After bridge 53 is melted out, additional material 78 may or may not be added as indicated at Arrow R to molten material 42. Additional material 78 will be added until the melting of a batch is completed or as otherwise desired. Typically, additional material is added until the molten material 42 reaches the full rated capacity of the molten material with respect to the crucible, as represented in FIG. 29. At this stage, molten material 42 is ready to be poured from crucible 22 via hole 29 or via another suitable pouring mechanism into, for example, tundish 16 (FIG. 1). Depending on the material to be molten and the ability to control the rate of pouring and melting, the pouring may begin in an earlier stage and additional material may be added as molten material 42 is poured from crucible 22.

Thus, a substantially more efficient method of melting materials is disclosed, especially for the melting of particulate material and even more particularly with regard to semi-conductor materials. It is noted that alternate induction starting methods may be used to initiate the melting of the material within the crucible. In particular, the so called "disappearing coil" method disclosed in co-owned patent application Ser. No. 10/851,565 is particularly appropriate in addition to the method described herein. Said Application is incorporated herein by reference in its entirety.

The inventive concept of the present method of layering and melting the material with reference to FIGS. 18-29 is not limited to the previous description wherein the wicking portion 54A or 54B is sensed by a sensor such as sensor 58. More particularly, a method of melting which is based on this method may be formulated so that a sensor is not required during the melt. More particularly, once a melt of a particular material within a given crucible has been performed at various power settings and other conditions, the information may be tracked in order to provide a calculated estimation of when it is appropriate to add the additional material to cover the wicking portion, that is, at an adding time which corresponds to, and preferably is nearly the same as, a wicking time which would be determined by a sensor sensing a discernable wicking portion as previously described. Thus, the method of melting described herein includes adding additional material at these estimated adding times which have been based on previous melting procedures and/or on estimated calculations which may be based strictly on calculations in light of material characteristics of the material to be melted and the specific configuration of the furnace to be used as well as the environmental aspects thereof. Thus, the adding time for a given addition of solid material may be prior to, simultaneous with or after a corresponding or associated wicking time, although the adding time is preferably near in time to the associated wicking time.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material;

insulating against heat loss from the molten material with the bridge;

moving the bridge upwardly from adjacent a lower end of the melting crucible by adding solid material into the crucible and melting solid material which forms part of the bridge;

inductively heating the molten material by coupling the molten material and an inductive member to produce in the molten material a meniscus having a top;

melting solid material of the bridge with the molten material at the top of the meniscus; and allowing molten material to move upwardly into spaces within the upper layer to form a wicking portion which comprises molten material at the top of the meniscus while maintaining a circumscribing portion of the upper layer which is free of molten material and circumscribes the wicking portion so that the wicking portion is one of optically and thermally discernible from a position above the upper layer.

2. The method of claim 1 further including the step of adding solid material to the bridge atop the wicking portion of the molten material within the bridge at an adding time which corresponds to a wicking time at which the wicking portion becomes discernible.

3. The method of claim 2 further including the step of sensing the wicking portion when it becomes discernible; and wherein the step of adding includes the step of adding the solid material atop the wicking portion upon sensing the wicking portion.

4. The method of claim 2 further including the step of maintaining the bridge at a thickness sufficient to prevent propulsion of molten material out of the crucible.

5. The method of claim 2 wherein the step of adding includes the step of adding solid material at a plurality of adding times which are at distinct intervals and each of which corresponds to a respective wicking time when a respective wicking portion of the molten material becomes discernible.

6. The method of claim 1 further including the step of covering the discernible wicking portion of molten material within the bridge so that the wicking portion is not discernible.

7. The method of claim 1 further including the step of maintaining the bridge during a process of melting solid material at least until the molten material reaches a volume sufficient to prevent electromotive forces from propelling molten material out of the melting crucible.

8. The method of claim 1 wherein the step of insulating includes the step of insulating with a bridge at least a portion of which alternately thickens and thins respectively as solid material is fed into the crucible and solid material of the bridge is melted.

9. The method of claim 1 wherein the step of melting solid material comprises the step of melting solid material within a melting cavity of a melting crucible in a bottom-up fashion to form molten material substantially all which is homogenous and extends upwardly from a bottom of the melting cavity to a bottom of the bridge and into the bridge so that a portion of the molten material is disposed in spaces between particles of solid material to form a wicking layer of the bridge below the upper layer.

10. The method of claim 1 wherein the step of melting less than all of the solid material comprises the step of forming an upwardly movable bridge comprising an upper layer formed of solid particulate material which entirely covers the molten material and which is free of molten material.

11. The method of claim 10 wherein the step of forming comprises the step of forming an upwardly movable bridge comprising a wicking layer which is below the upper layer, entirely covers the molten material and is formed of solid particulate material and molten material having moved upwardly into spaces between particles of the solid particulate material.

12. The method of claim 11 further comprising the step of melting a portion of the solid material of the bridge so that molten material within the wicking layer moves upwardly into spaces between particles of the solid particulate material in the upper layer to form the wicking portion sufficiently adjacent an upper surface of the upper layer to be one of thermally and optically discernible from the position above the upper layer.

13. The method of claim 12 further comprising the steps of sensing the wicking portion when it becomes discernible; and, upon sensing the wicking portion, adding solid particulate material atop the wicking portion to entirely cover the wicking portion with solid particulate material which is free of molten material.

14. The method of claim 1 wherein the step of melting solid material comprises the step of melting solid material within a melting crucible having a sidewall with an inner perimeter circumscribing a melting cavity in which the molten material is contained; and the step of melting less than all of the solid material comprises the step of forming an upwardly movable bridge comprising a first upper layer formed of solid particulate material which is disposed above the molten material, is free of molten material and is in contact with the inner perimeter all the way around the inner perimeter in a continuous manner.

15. The method of claim 14 further comprising the step of melting the entire first upper layer while adding solid particulate material on an upper surface of the first upper layer to form atop the first upper layer a subsequent second upper layer formed of solid particulate material which is free of molten material and is in contact with the inner perimeter all the way around the inner perimeter in a continuous manner.

16. The method of claim 1 further comprising the step of increasing a thickness of the upper layer by adding solid particulate material into the crucible from above the upper layer so that the resulting upper layer of increased thickness is free of molten material.

17. The method of claim 16 further comprising the step of reducing the thickness of the resulting upper layer by heating the molten material to melt a portion of the upper layer with the molten material in a bottom-up fashion.

18. The method of claim 1 wherein the step of melting solid material comprises the step of melting solid material within a melting crucible in a bottom-up fashion to form an original bath of molten material; and the step of melting less than all of the solid material comprises the step of forming an upwardly movable bridge comprising an upper layer formed of solid particulate material which is disposed above the original bath of molten material and is free of molten material; and further comprising the step of melting the bridge entirely to form molten bridge material substantially all of which mixes with the original bath of molten material to form a molten mixture.

19. The method of claim 18 further comprising the step of transferring the mixture out of the melting crucible.

20. The method of claim 19 further comprising the step of producing a solid product from the transferred mixture.

21. The method of claim 20 wherein the step of producing comprises the step of producing a semi-conductor crystal from the transferred mixture.

22. The method of claim 1 wherein the step of melting solid material comprises the step of melting solid material within a melting cavity of a melting crucible in a bottom-up fashion to form molten material so that substantially all of the molten material within the melting cavity is homogenous.

23. The method of claim 22 wherein the step of melting solid material comprises the step of melting solid material within a melting cavity of a melting crucible in a bottom-up fashion to form molten material within the melting cavity substantially all of which is material from which a semi-conductor crystal may be formed.

24. The method of claim 23 wherein the step of melting solid material comprises the step of melting solid material within a melting cavity of a melting crucible in a bottom-up fashion to form molten material substantially all of which is silicon.

25. The method of claim 24 further comprising the step of feeding into the melting cavity solid feed material substantially all of which is quartz; and wherein the step of melting the solid material comprises the step of melting the quartz within the melting cavity to form the molten silicon; and the step of melting less than all of the solid material comprises the step of melting less than all of the quartz to form the upwardly movable bridge whereby substantially all of the material forming the upper layer of the bridge is quartz and whereby the quartz upper layer abuts the molten silicon.

26. The method of claim 23 wherein the step of melting solid material comprises the step of melting solid material within a melting cavity of a melting crucible in a bottom-up fashion to form molten material substantially all of which is germanium.

27. The method of claim 22 further comprising the step of feeding into the melting cavity solid feed material substantially all of which is meltable to form molten material substantially all of which is homogenous; and wherein the step of melting the solid feed material comprises the step of melting the solid feed material within the melting cavity to form the homogenous molten material; and the step of melting less than all of the solid material comprises the step of melting less than all of the solid feed material to form the upwardly movable bridge whereby substantially all of the upper layer is formed of the solid feed material and whereby the solid feed material upper layer abuts the homogenous molten material.

28. The method of claim 27 wherein the step of feeding comprises the step of feeding into the melting cavity solid feed material substantially all of which is semiconductor raw material.

29. The method of claim 28 wherein the step of placing comprises the step of placing in the melting cavity solid feed material substantially all of which is quartz.

30. The method of claim 1 further comprising prior to the step of melting solid material the steps of:

placing solid material within a melting cavity of the melting crucible wherein the melting crucible is electrically non-conductive;

positioning an electrically conductive member and the induction member so that a portion of the melting cavity is closer to the induction member than is the conductive member, so that no portion of the melting cavity surrounds any portion of the conductive member and so that the electrically conductive member is in a fixed relation with respect to the crucible;

heating the conductive member inductively with the induction member; and transferring heat from the conductive member to the material; and wherein the step of melting solid material comprises the step of heating a portion of the material inductively by coupling the portion with the induction member.

31. The method of claim 30 wherein the step of positioning comprises the step of positioning an electrically conductive member adjacent a bottom wall of the melting crucible and an induction coil so that the induction coil circumscribes the crucible and is substantially concentric with an outer perimeter of the conductive member.

32. The method of claim 1 further comprising prior to the step of melting solid material the steps of:

placing solid material which is not initially susceptible to direct inductive heating within a melting cavity of the melting crucible wherein the melting crucible is electrically non-conductive;

positioning an electrically conductive member and the induction member so that a portion of the melting cavity is closer to the induction member than is the conductive member and so that the electrically conductive member is in a fixed relation with respect to the crucible;

heating the conductive member inductively with the induction member; and transferring heat from the conductive member to the solid material to make a portion thereof susceptible to direct inductive heating; and further comprising the step of:

heating the susceptible portion inductively by coupling the susceptible portion with the induction member.

33. The method of claim 32 wherein the step of positioning comprises the step of positioning an electrically conductive member adjacent a bottom wall of the melting crucible and an induction coil so that the induction coil circumscribes the crucible and is substantially concentric with an outer perimeter of the conductive member.

34. The method of claim 1 further comprising the step of placing solid material within the melting crucible on a bottom wall thereof; and wherein the step of melting solid material comprises the step of melting solid material within the melting crucible in a bottom-up fashion to form molten material along the bottom wall; and the step of melting less than all of the solid material comprises the step of melting less than all of the solid material to form an upwardly movable bridge comprising an upper layer formed of solid particulate material which is disposed above the molten material, is adjacent the bottom wall and is free of molten material.

35. The method of claim 34 wherein the step of melting less than all of the solid material comprises the step of melting less than all of the solid material to form an upwardly movable bridge comprising an upper layer formed of solid particulate material which is disposed above the molten material, contacts the bottom wall and is free of molten material.

36. The method of claim 1 wherein the step of moving comprises the step of moving the bridge upwardly from a first position in which an uppermost surface of the bridge is at a first height to a second position in which a lowermost surface of the bridge is at a second height which is higher than the first height while maintaining an upper layer of the bridge formed of solid particulate material which is disposed above the molten material and is free of molten material.

37. The method of claim 36 wherein the step of moving comprises the step of moving the bridge upwardly from a first position in which an uppermost surface of the bridge is at a first height adjacent the lower end of the crucible to a second position in which a lowermost surface of the bridge is at a second height which is higher than the first height and the uppermost surface of the bridge is at least halfway to an uppermost end of the crucible while maintaining an upper layer of the bridge formed of solid particulate material which is disposed above the molten material and is free of molten material.

38. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material and a wicking layer below the upper layer, above the molten material and formed of solid particulate material and molten material having moved upwardly into spaces between particles of the solid particulate material;

insulating against heat loss from the molten material with the bridge;

moving the bridge upwardly from adjacent a lower end of the melting crucible by adding solid material into the crucible and melting solid material which forms part of the bridge;

heating the molten material inductively by electromagnetically coupling the molten material and an inductive member to produce in the molten material a positive meniscus having a top;

melting solid material of the bridge with the molten material at the top of the meniscus to form a wicking portion within the wicking layer which comprises molten material at the top of the meniscus while maintaining a circumscribing portion of the upper layer which is free of molten material and circumscribes the wicking portion so that the wicking portion is visibly discernible relative to the circumscribing portion from a position above the upper layer; and further comprising the steps of:

sensing the wicking portion of the molten material within the bridge; and adding solid material atop the wicking portion upon sensing the wicking portion.

39. The method of claim 38 wherein the step of adding comprises the step of adding solid material atop the wicking portion only upon sensing that the wicking portion has moved upwardly within the upper layer so as to reduce the distance between the wicking portion and an upper surface of the upper layer.

40. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material;

insulating against heat loss from the molten material with the bridge;

maintaining the bridge during a process of melting solid material at least until the molten material reaches a volume sufficient to prevent electromotive forces from propelling molten material out of the melting crucible; and melting the bridge entirely when the molten material reaches a volume nearly equal to a full rated capacity of the molten material with respect to the melting crucible.

41. The method of claim 40 further comprising the step of maintaining a first portion of the upper layer as solid particulate material free of molten material, and while so maintaining the first portion, the step of:

melting a second portion of the upper layer to allow molten material to move upwardly into spaces in the solid particulate material in the upper layer to form a wicking portion of solid and molten material which is one of thermally and optically discernible from a position above the upper layer.

42. The method of claim 40 further comprising the steps of inductively heating the molten material by coupling the molten material and inductive member to produce in the molten material a meniscus having a top; melting solid material of the bridge with the molten material at the top of the meniscus; and allowing molten material to move upwardly into spaces within the upper layer to form a wicking portion which comprises molten material at the top of the meniscus while maintaining a circumscribing portion of the upper layer which is free of molten material and circumscribes the wicking portion so that the wicking portion is one of optically and thermally discernible from a position above the upper layer.

43. A method comprising the steps of:

melting solid material within a melting crucible in a bottom-up fashion to form molten material;

melting less than all of the solid material to form an upwardly movable bridge comprising solid material disposed above the molten material;

insulating against heat loss from the molten material with the bridge;

solidifying molten material to form a solidified layer within the bridge;

creating a hole through the solidified layer of the bridge;

adding additional solid material to the molten material through the hole; and melting the additional solid material.

44. The method of claim 43 further including the step of:

adding solid material to the bridge atop a wicking portion of the molten material within the bridge at an adding time which corresponds to a wicking time at which the wicking portion becomes discernible;

wherein the step of adding includes the step of adding solid material at a plurality of adding times which are at distinct intervals and each of which corresponds to a respective wicking time when a respective wicking portion of the molten material becomes discernible;

wherein the step of adding solid material at a plurality of adding times is repeated until the molten material is inductively coupled to an induction member; and further including the step of melting the bridge entirely.

45. The method of claim 43 further including the step of heating the molten material inductively with an induction member; and wherein the step of creating the hole includes the step of increasing a power level of the induction member to heighten a meniscus of the molten material to melt a portion of the bridge.

46. The method of claim 43 wherein the step of creating the hole includes the step of contacting the bridge with a bridge breaker to break the solidified layer.

47. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material and a wicking layer below the upper layer, above the molten material and formed of solid particulate material and molten material having moved upwardly into spaces between particles of the solid particulate material;

insulating against heat loss from the molten material with the bridge; and solidifying the molten material within the wicking layer while maintaining the molten material therebelow in a molten state.

48. The method of claim 47 further including the step of forming the molten material and the bridge by heating a susceptor inductively with an induction member and transferring heat from the susceptor to solid material within the crucible to melt a portion thereof.

49. The method of claim 48 further including the step of heating the molten material inductively by coupling of the molten material and the induction member.

50. The method of claim 47 further comprising the step of forming a space between the bridge and the molten material which insulates the wicking layer from the molten material therebelow and thereby results in the step of solidifying.

51. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material;

insulating against heat loss from the molten material with the bridge; and forming a space between the bridge and the molten material.

52. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material;

insulating against heat loss from the molten material with the bridge;

moving the bridge upwardly from adjacent a lower end of the melting crucible by adding solid material into the crucible and melting solid material which forms part of the bridge;

maintaining a first portion of the upper layer as solid particulate material free of molten material, and while so maintaining the first portion, the step of:

melting a second portion of the upper layer to allow molten material to move upwardly into spaces in the solid particulate material in the upper layer to form a wicking portion of solid and molten material which is one of thermally and optically discernible from a position above the upper layer; and during the step of maintaining the first portion, the steps of sensing the wicking portion with one of a thermal and optical sensor disposed at the position above the upper layer; and, upon sensing the wicking portion, adding additional solid particulate material to form atop the wicking portion a layer of solid particulate material which is free of molten material.

53. The method of claim 52 further including the step of heating the molten material inductively by coupling of the molten material and the induction member.

54. A method comprising the steps of:

melting solid material within a melting crucible in a bottom-up fashion to form molten material;

melting less than all of the solid material to form an upwardly movable bridge comprising an upper layer formed of solid particulate material which is disposed above the molten material and is free of molten material and a wicking layer which is below the upper layer and is formed of solid particulate material and molten material having moved upwardly into spaces between particles of the solid particulate material;

insulating against heat loss from the molten material with the bridge;

moving the bridge upwardly from adjacent a lower end of the melting crucible by adding solid material into the crucible and melting solid material which forms part of the bridge; and further comprising the steps of sensing thermally or optically a wicking portion of the wicking layer when the wicking portion moves upwardly sufficiently close to an upper surface of the upper layer to be discerned; adding a layer of solid material atop the wicking portion upon sensing the wicking portion; repeating in an alternating fashion the steps of sensing and adding so that the steps of adding are performed in an intermittent fashion so that each added layer of solid material is in response to a corresponding one of the steps of sensing; raising the level of molten material within the melting cavity and moving the bridge upwardly by the repeated steps of adding and by melting solid material which forms part of the bridge subsequent to each step of adding.

* * * * *